US006993801B2

(12) United States Patent
Marko et al.

(10) Patent No.: US 6,993,801 B2
(45) Date of Patent: Feb. 7, 2006

(54) VARIABLE RAMP ASSEMBLIES AND SYSTEM THEREFOR

(75) Inventors: Neil L. Marko, Hillsdale, MI (US); Charles A. Heitmeyer, Napoleon, OH (US)

(73) Assignee: Land Wave Products, Inc., Pioneer, OH (US)

( * ) Notice: Subject to any disclaimer, the term of this patent is extended or adjusted under 35 U.S.C. 154(b) by 168 days.

(21) Appl. No.: 10/613,168

(22) Filed: Jul. 3, 2003

(65) Prior Publication Data

US 2005/0000042 A1 Jan. 6, 2005

(51) Int. Cl.
*E04F 11/00* (2006.01)

(52) U.S. Cl. ..... 14/69.5

(58) Field of Classification Search ..... 14/69.5, 14/71.1; 104/275; 254/88
See application file for complete search history.

(56) References Cited

U.S. PATENT DOCUMENTS

| | | | | |
|---|---|---|---|---|
| 2,450,648 A | * | 10/1948 | Felzer | 254/88 |
| 3,970,300 A | | 7/1976 | von Wendt et al. | |
| 4,129,916 A | | 12/1978 | Schlesinger et al. | |
| 4,285,514 A | | 8/1981 | Romero | |
| 4,484,739 A | | 11/1984 | Kreinbihl et al. | |
| 4,712,264 A | | 12/1987 | Voith | |
| 4,817,224 A | * | 4/1989 | Visnaw et al. | 14/69.5 |
| 4,900,217 A | | 2/1990 | Nelson | |
| 5,066,000 A | | 11/1991 | Dolan | |
| 5,137,497 A | | 8/1992 | Dubeta | |
| 5,214,817 A | | 6/1993 | Allen | |
| 5,277,436 A | | 1/1994 | Frank et al. | |
| 5,341,533 A | * | 8/1994 | Seitz | 14/69.5 |
| 5,347,672 A | | 9/1994 | Everard et al. | |
| 5,440,773 A | | 8/1995 | Lentini | |
| 5,446,937 A | | 9/1995 | Haskins | |
| 5,509,244 A | | 4/1996 | Bentzon | |
| 5,524,310 A | | 6/1996 | Farnen | |
| 5,566,622 A | * | 10/1996 | Ziaylek et al. | 104/275 |
| 5,599,235 A | | 2/1997 | Lynberg | |
| 5,673,517 A | * | 10/1997 | Stanclift | 49/468 |
| 5,688,078 A | * | 11/1997 | Hammer | 405/286 |
| 5,718,412 A | | 2/1998 | Levanas | |
| 5,740,575 A | | 4/1998 | Gordon | |
| 5,749,615 A | | 5/1998 | Itson | |
| 5,765,707 A | * | 6/1998 | Kenevan | 220/4.28 |
| 5,777,266 A | * | 7/1998 | Herman et al. | 174/68.1 |
| 5,855,076 A | * | 1/1999 | Warner et al. | 33/562 |
| 5,860,867 A | | 1/1999 | Deusen | |
| 5,897,438 A | | 4/1999 | Kunz et al. | |
| 5,946,756 A | | 9/1999 | Mapp | |
| 6,042,480 A | | 3/2000 | Labelson | |

(Continued)

FOREIGN PATENT DOCUMENTS

| | | | |
|---|---|---|---|
| GB | 2240801 A | * | 8/1991 |
| WO | 200102667 A | * | 1/2001 |

*Primary Examiner*—Robert E. Pezzuto
*Assistant Examiner*—Alexandra K. Pechhold
(74) *Attorney, Agent, or Firm*—Harness, Dickey & Pierce, P.L.C.

(57) ABSTRACT

A variable stackable ramp system for forming ramp assemblies for providing challenging obstacle courses including ones for aerial lift for sport jumping with skateboards, inline skates, bicycles and the like. The ramp system includes ramp modules of at least two different configurations with one being an inclined ramp module having an inclined upper riding or support surface and a straight ramp module having a generally horizontal straight upper riding or support surface. The ramp modules are adapted to be interconnected horizontally and vertically in a variety of orientations to provide ramp assemblies of selectively different overall configurations.

47 Claims, 15 Drawing Sheets

U.S. PATENT DOCUMENTS 6,439,543 B1 * 8/2002 Peckham ..... 254/88
6,463,613 B1 10/2002 Thompson
6,481,036 B1 * 11/2002 Duvall ..... 14/69.5
6,654,977 B1 12/2003 Chin
6,672,968 B2 1/2004 Montolio ..... 472/89
6,676,529 B2 1/2004 Pernal ..... 472/89
6,695,707 B1 2/2004 Fernandez
6,715,177 B1 4/2004 Lagergren-Julander
6,745,422 B1 6/2004 Emerson, Jr.
6,782,577 B2 8/2004 Rieber et al.
2002/0124332 A1 * 9/2002 Janowak ..... 14/69.5

* cited by examiner 12
16
18a
20
22a
23a
24a
26a
30
90
AI
Li 12
16
90
92
93
94
95
AI

VARIABLE RAMP ASSEMBLIES AND SYSTEM THEREFOR

FIELD OF THE INVENTION

The present invention relates to ramps for providing aerial lift for sport jumping with skateboards, inline skates, bicycles and the like and, more particularly, a system for creating ramp assemblies that can be readily assembled to selectively provide obstacle courses of a variety of configurations with different challenge levels and can be readily disassembled for transport or storage.

BACKGROUND OF THE INVENTION

There are a variety of ramp designs for skateboard, inline skates and bicycle enthusiasts for performing simple aerial jumps or complex aerial acrobatics or other forms of ramp challenges. Such activities are generally performed on straight inclined ramp surfaces or arcuate surfaces some of which may extend as much as a half pipe. In addition there are collapsible and/or modular ramp assemblies some of which are used for the transport of wheeled vehicles such as wheelchairs, carts and the like.

Even with prior modular or collapsible ramp assemblies such structures provide only limited, selective versatility of the final desired configuration and hence use.

In the present invention a system for modular ramp assemblies is provided comprising a plurality of similar ramp modules of at least two different structures which can be selectively assembled together vertically and horizontally to define ramp assemblies having a variety of desired overall configurations. Here one of the modules is an inclined ramp module having an inclined upper support, or riding surface and another module a straight module having a straight, flat upper support or riding surface. These surfaces are adapted to be readily operatively joined together to form configurations with desired contours.

With the versatile system of the present invention the modules can be selectively assembled to provide ramp assemblies of multiple lengths, multiple widths and multiple ramp elevations along with a large variety of overall contours. In addition the modules are provided with unique interfitting structures whereby the modules can be readily manually assembled and disassembled without the need for special tools. In addition each module is of a relatively lightweight structure to facilitate handling.

SUMMARY OF THE INVENTION

In the present invention, a unique modular ramp system is provided to permit the user to selectively vary the overall contour of the ramp assembly as finally assembled.

Here a plurality of modules of at least two different configurations are used. A first module is provided with an inclined upper support or riding surface with the inclined surface extending substantially over the entire upper surface. A second module is substantially rectangular having a straight, generally horizontal planar upper support or riding surface extending substantially over the entire upper surface.

In one form the first and second modules are of substantially the same width and length. In addition the upper end of the inclined surface of the inclined ramp module is of substantially the same height as the uniform height of the rectangular module to provide continuity between the support surfaces when operatively connected together in line. This then facilitates assembly of the modules together in a large variety of selected configurations.

In addition, a simple, unique structure is provided for selectively interconnecting the modules together length wise (end-to-end), width wise (side-by-side), width-to-length (end-to-side) and/or stacked one on top of the other. This simple structure facilitates an ease of assembly and disassembly of the modules into a variety of overall structural ramp assemblies.

At the same time the capability of providing a selective variety of configurations of ramp assemblies can be done with the use of modules of only two different structures. This then minimizes the overall cost of manufacture for a reasonable cost to the end user.

Therefore, it is an object of the present invention to provide ramp modules of unique structures for facilitating the formation of ramp assemblies of different overall contours.

It is another object of the present invention to provide a modular ramp system having a plurality of ramp modules which can be connected together horizontally and vertically in a variety of ways to provide ramp assemblies of numerous, selectively desirable overall contours.

It is another object of the present invention to provide a modular ramp system including a plurality of ramp modules of different constructions with a structure facilitating relatively easy assembly and disassembly.

It is another object of the present invention to provide a modular ramp system including a plurality of ramp modules of two different structures to provide ramp assemblies of selectively desirable contours.

It is also an object of the present invention to provide ramp modules of unique structures for forming unique structural ramp assemblies.

It is still another object of the present invention to provide a unique modular ramp system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
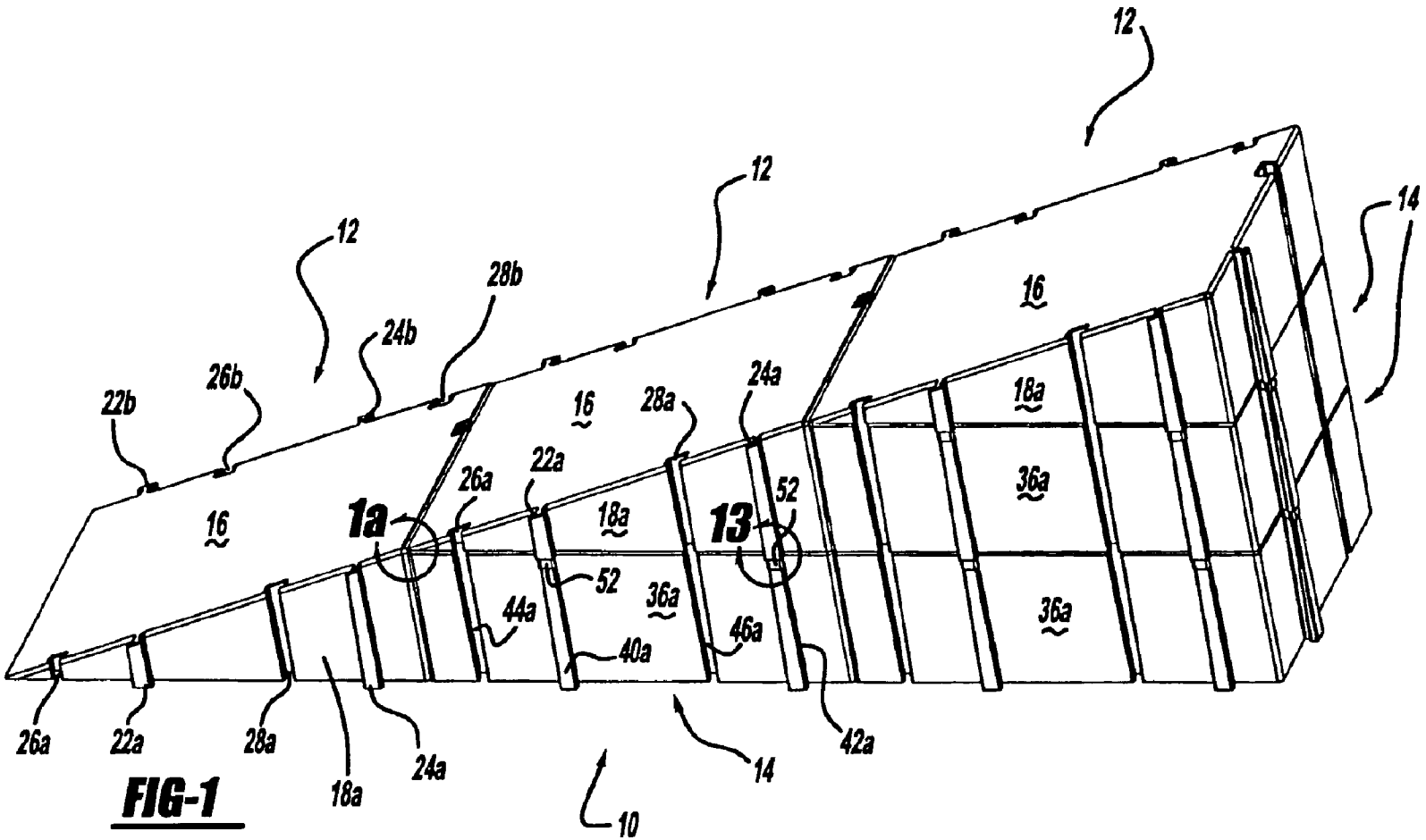
FIG. 1 is a perspective view of one form of a ramp assembly including inclined ramp modules having an inclined, straight upper riding or support surface and straight modules having a straight, planar, generally horizontal upper riding or support or surface.

Looking now to FIG. 1, a modular ramp assembly 10, of one form, is shown and is made up of a plurality of inclined ramp modules 12 of one uniform structure and straight ramp modules 14 of a second uniform structure. The inclined ramp modules 12 are generally of a right triangular, wedge shape while the straight ramp modules 14 are generally of a rectangular box shape. Both the inclined ramp modules 12 and straight ramp modules 14 are of a generally lightweight, hollow construction to be described.

Figure 3:
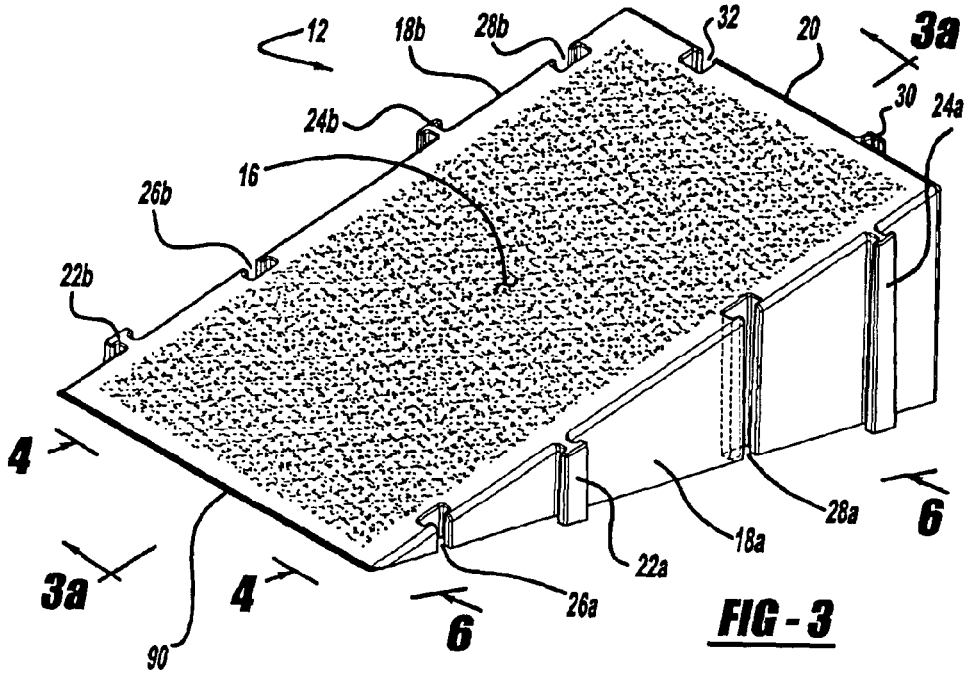
FIG. 3 is an upper perspective view of an inclined ramp module with T-shaped connecting protrusions and T-shaped connecting grooves for connection with other ramp modules.
Figure 4:
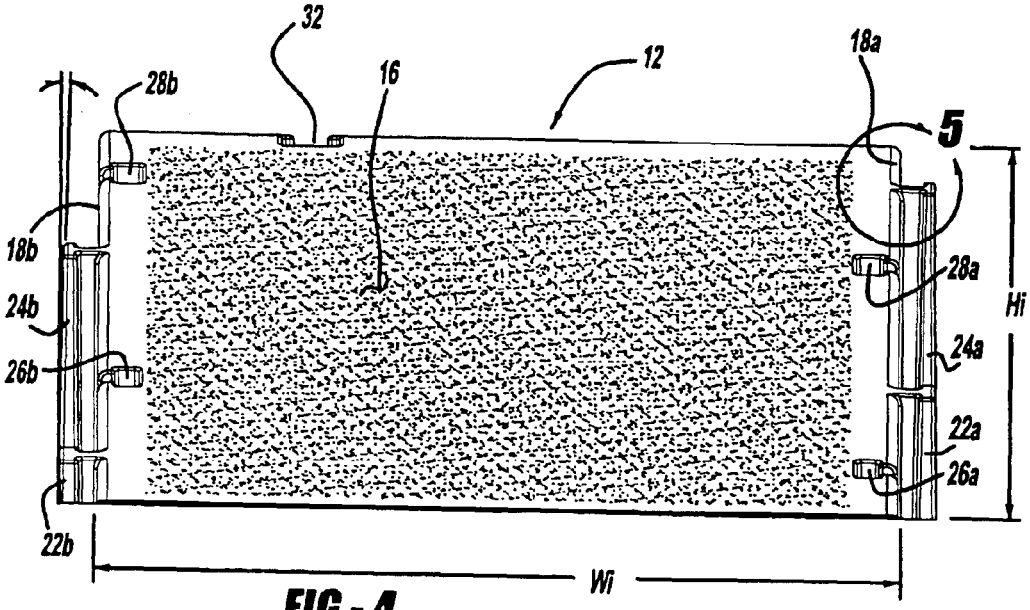
FIG. 4 is a front end elevational view of the inclined ramp module of FIG. 3 taken in the direction of the Arrows 4—4 in FIG. 3.
Figures 3A, 6:
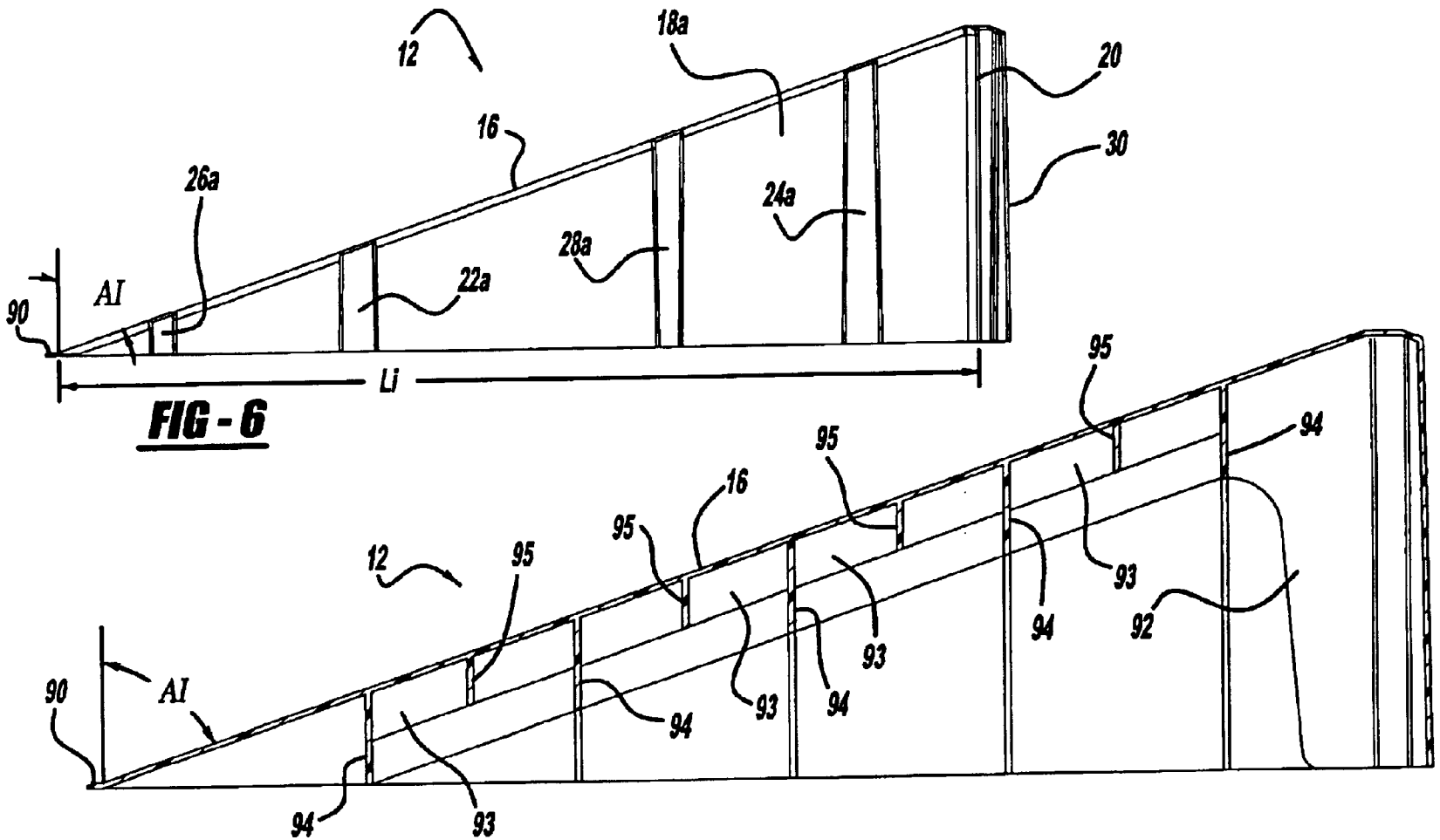
FIG. 3*a* is a longitudinal sectional view along the length of the inclined ramp module of FIG. 3 and taken generally along the line and in the direction of the Arrows 3*a*—3*a* in FIG. 3.
FIG. 6 is a side elevational view of the inclined ramp module of FIG. 3 taken in the direction of the Arrows 6—6 in FIG. 3.
Figure 5:
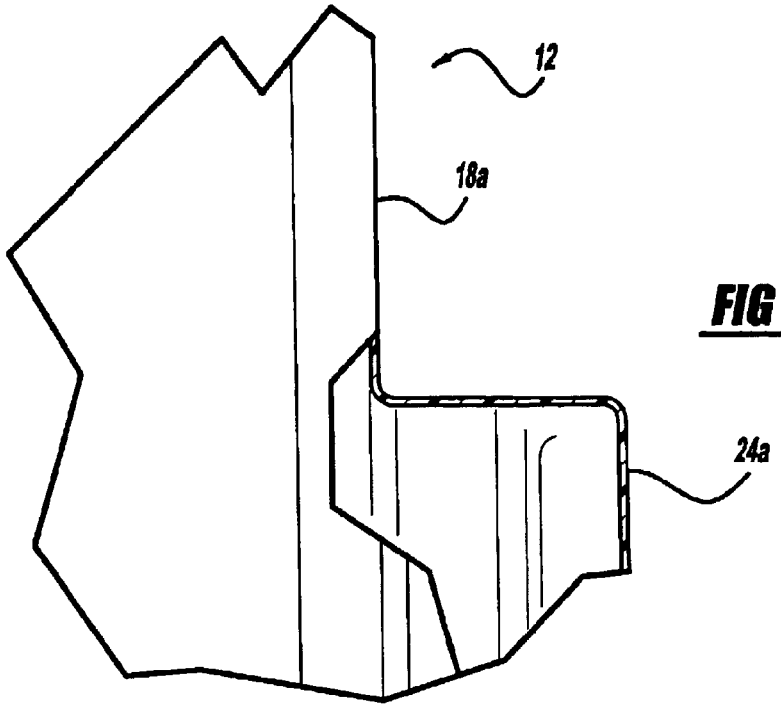
FIG. 5 is an enlarged fragmentary view with some parts shown in section of the portion of the inclined ramp module of FIG. 4 taken generally in the Circle 5 in FIG. 4.

FIGS. 3, 4 and 6 show the inclined ramp module 12, to have an inclined, straight, planar rectangular upper support or riding surface 16 supported on opposite sides by generally triangularly shaped side walls 18*a* and 18*b* and at the upper end by a generally rectangularly shaped end wall 20. The side wall 18*a* has a plurality of longitudinally spaced T-shaped connecting protrusions 22*a* and 24*a* and a plurality of longitudinally spaced T-shaped connecting channel grooves 26*a* and 28*a*. As can be seen the connecting protrusions 22*a* and 24*a* are alternately spaced relative to the connecting channel grooves 26*a* and 28*a*. The opposite side wall 18*b* has T-shaped connecting protrusions 22*b* and 24*b* which are longitudinally offset from the opposite sided connecting protrusions 22*a* and 24*a* and are substantially in transverse alignment with the T-shaped channel grooves 26*a* and 28*a*, respectively. Likewise, the side wall 18*b* has T-shaped channel grooves 26*b* and 28*b* which are substantially in transverse alignment with the T-shaped protrusions 22*a* and 24*a*, respectively. Such alignment serves a connecting purpose to be described. The end wall 20 has a T-shaped connecting protrusion 30 and a T-shaped connecting channel groove 32. FIG. 5 is a fragmentary partially sectioned view depicting the upper end of the T-shaped protrusion 24*a*.

Figure 9:
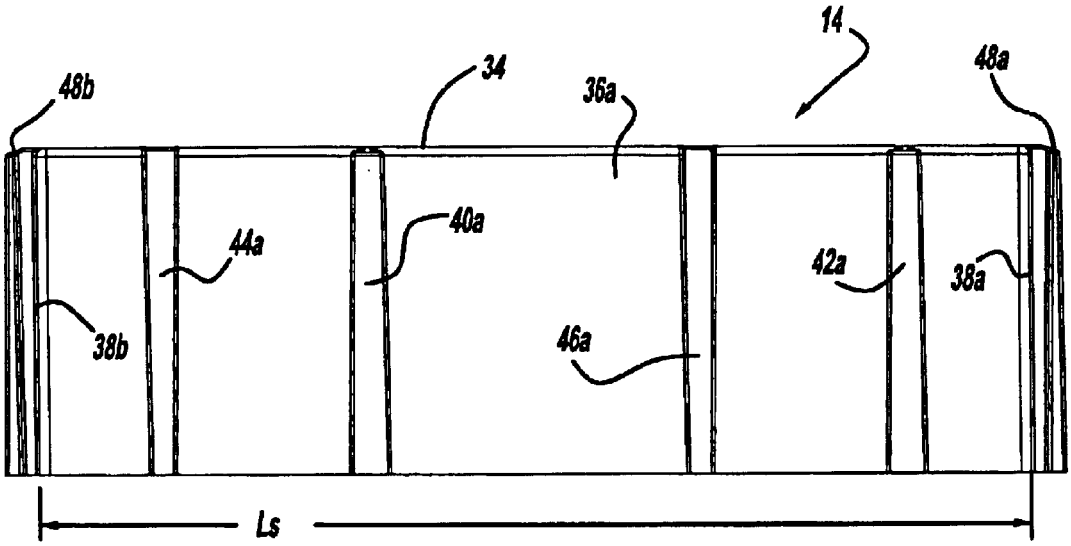
FIG. 9 is a side elevational view of the straight ramp module of FIG. 7 taken in the direction of the Arrows 9—9 in FIG. 7.
Figure 7:
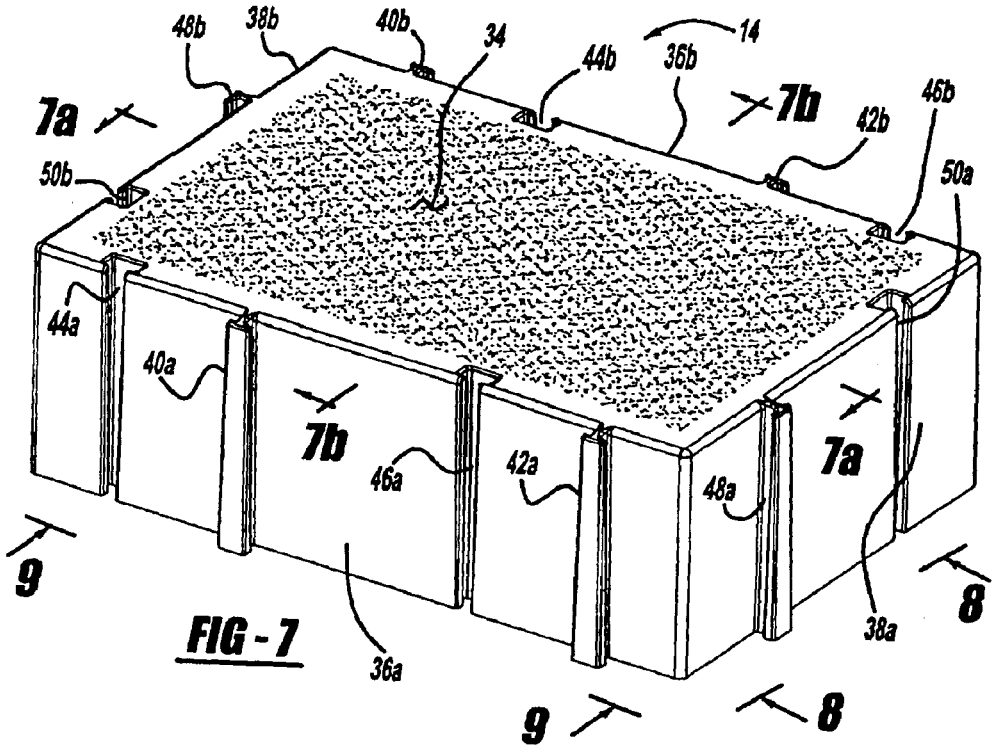
FIG. 7 is an upper perspective view of a straight ramp module with T-shaped connecting protrusions and T-shaped connecting grooves for connection with other ramp modules.
Figure 8:
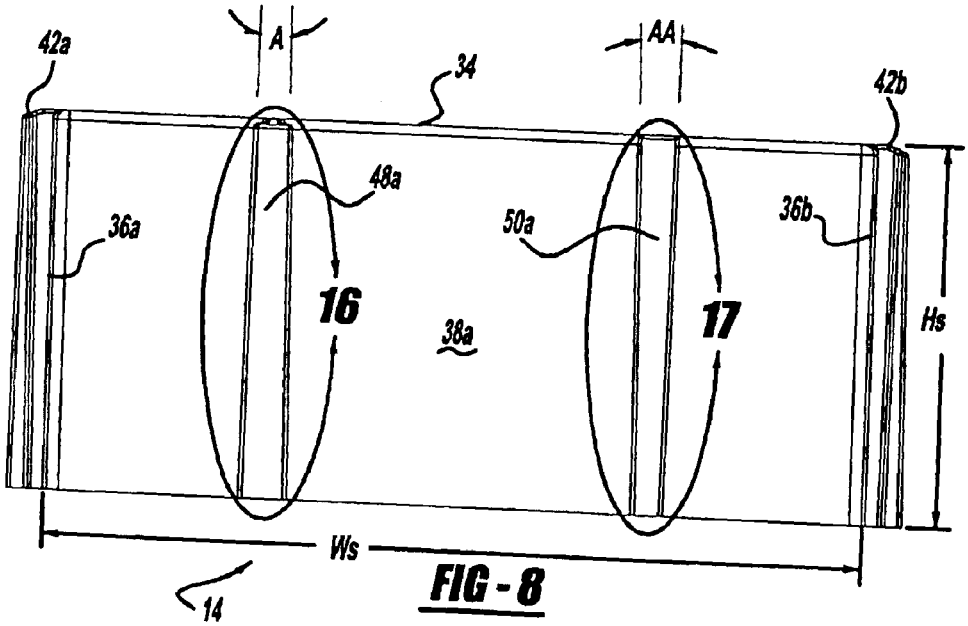
FIG. 8 is an end elevational view of the straight ramp module of FIG. 7 taken in the direction of the Arrows 8—8 in FIG. 7.

FIGS. 7, 8 and 9 show the straight ramp module 14.

As will be seen the T-shaped protrusions and T-shaped grooves provide a unique and simple way of slidably connecting the ramp modules to form assemblies of a variety of horizontal and vertical configurations.

The straight ramp module 14 has a generally horizontal rectangular, straight or planar upper riding or support surface 34 which is supported on opposite sides by generally rectangularly shaped side walls 36*a* and 36*b* and at opposite ends by generally rectangularly shaped front and rear end walls 38*a* and 38*b*, respectively. The side wall 36*a* has a pair of longitudinally spaced T-shaped connecting protrusions

40*a* and 42*a* and a plurality of longitudinally spaced T-shaped connecting channel grooves 44*a* and 46*a*. Again, the connecting protrusions 40*a* and 42*a* are alternately spaced relative to the connecting channel grooves 44*a* and 46*a*. The opposite side wall 36*b* has T-shaped connecting protrusions 40*b* and 42*b* which are longitudinally offset from the opposite side protrusions 40*a* and 42*a* and are substantially in transverse alignment with the T-shaped channel grooves 44*a* and 46*a*. Likewise the side wall 36*b* has T-shaped connecting channel grooves 44*b* and 46*b* which are longitudinally offset from the opposite side channel grooves 44*a* and 46*a* and are substantially in transverse alignment with the T-shaped protrusions 40*a* and 42*a*, respectively.

The front end wall 38*a* has a T-shaped connecting protrusion 48*a* and a transversely spaced T-shaped connecting channel groove 50*a*. The rear end wall 38*b* has a T-shaped connecting protrusion 48*b* in longitudinal alignment with the T-shaped channel groove 50*a* and a transversely spaced T-shaped connecting channel groove 50*b* in longitudinal alignment with the T-shaped protrusion 48*a*.

In all of the above, the T-shaped protrusions and T-shaped grooves on the inclined ramp modules 12 and on the straight ramp modules 14 are of similar constructions and equally spaced with the T-shaped protrusions adapted to slidingly fit within the T-shaped channel grooves to connect an inclined module 12 and straight ramp module 14 together end-to-end. In this regard the shortened T-shaped protrusions 22*a, b* and 24*a, b* and shortened T shaped channel grooves 26*a, b* and 28*a, b* of the inclined ramp modules 12 are of substantially the same contour as the full length T-shaped protrusion 30 and channel groove 32 at their same lower sections.

At the same time, the transverse spacing between the protrusion 30 and channel groove 32 in the end wall 20 of inclined ramp modules 12 and between the end protrusions 48*a* and 48*b* and end channel grooves 50*a* and 50*b* in end walls 38*a* and 38*b* of the straight ramp modules 14 is inversely the same to provide interfitting end-to-end connection. Also the longitudinal spacing between the side protrusions 22*a*, 24*a* and side channel grooves 26*b*, 28*b* and side protrusions 22*b*, 24*b* and side channel grooves 26*a*, 28*a* in side walls 18*a*, 18*b* of the inclined ramp modules 12 is inversely the same to provide interfitting side-by-side connection between two inclined ramp modules.

Along the same line, the protrusion 48*a* and channel groove 50*a* in the end wall 38*a* of the straight ramp modules 14 are longitudinally in line with the channel groove 50*b* and protrusion 48*b*, respectively, in the opposite end wall 38*b* to provide end-to-end connection. Also the longitudinal spacing between the channel grooves 44*a*, 46*a* on side wall 36*a* and protrusions 40*b*, 42*b* on side wall 36*b* is the same placing them in transverse alignment and the spacing between protrusions 40*a*, 42*a* on side wall 36*a* and channel grooves 44*b*, 46*b* is the same also placing these in transverse alignment to provide interfitting side-by-side connection between two straight ramp modules 14.

Figures 1A, 2:
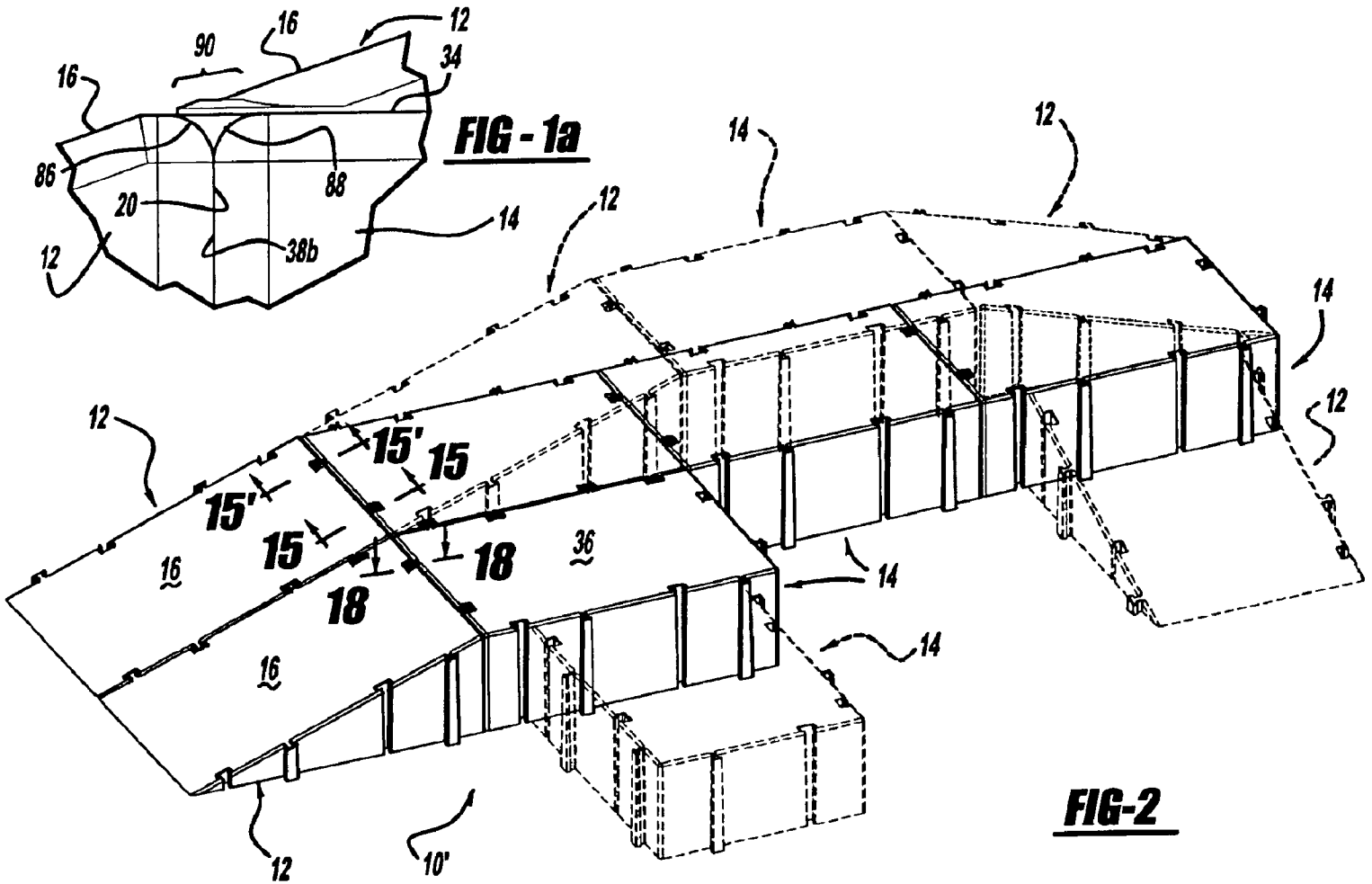
FIG. 1*a* is an enlarged fragmentary view of a portion of the ramp assembly taken generally in the Circle 1*a* in FIG. 1.
FIG. 2 is a perspective view similar to FIG. 1 with a number of inclined ramp modules and straight ramp modules shown in phantom and illustrating different possible horizontal and vertical interconnections between modules for forming a variety of different ramp assemblies.

In this regard, it can be seen from FIG. 2 that the inversely uniform spacing of T-shaped connecting grooves and T-shaped connecting projections on the end and side surfaces of the inclined ramp modules 12 and straight ramp modules 14 are uniform whereby the end wall 20 of the inclined ramp module 12 can also be connected to either of the side walls 36*a*, 36*b* of the straight ramp modules 14 and likewise either end wall 38*a*, 38*b* of a straight ramp module 14 can be connected to either of the side walls 36*a*, 36*b* of another straight ramp module 14. Thus the inclined ramp modules 12 and straight ramp modules 14 can be connected together in a substantial variety of vertical and horizontal combinations. Examples of such variations in assembly are shown in FIG. 2 with some members shown in phantom. In this regard, it can be seen in FIG. 2 that ramp assemblies can be selectively erected with inclined ramps 12 at the beginning and end such that there may be little or no aerial left. This clearly shows that ramp assemblies can be assembled to provide obstacle courses of a selected variety of challenge levels. It can also be seen then that the orientation of the T-shaped projections and T-shaped grooves of the inclined ramp modules 12 and straight ramp modules 14 facilitates the ease of assembly since no particular orientation is required for end-to-end or side-to-side connection.

As can be seen from FIG. 1, the width and height of the end wall 20 of the inclined ramp modules 12 and of the end walls 38*a* and 38*b* of the straight ramp modules 14 are the same such that an inclined ramp module 12 and straight ramp module 14 are in an in-line alignment when assembled end-to-end. In addition the lengths of the inclined ramp modules 12 and the straight ramp modules 14 are the same to provide alignment for vertical stacking when an inclined ramp module 12 is stacked on top of a straight ramp module 14.

Figure 10:
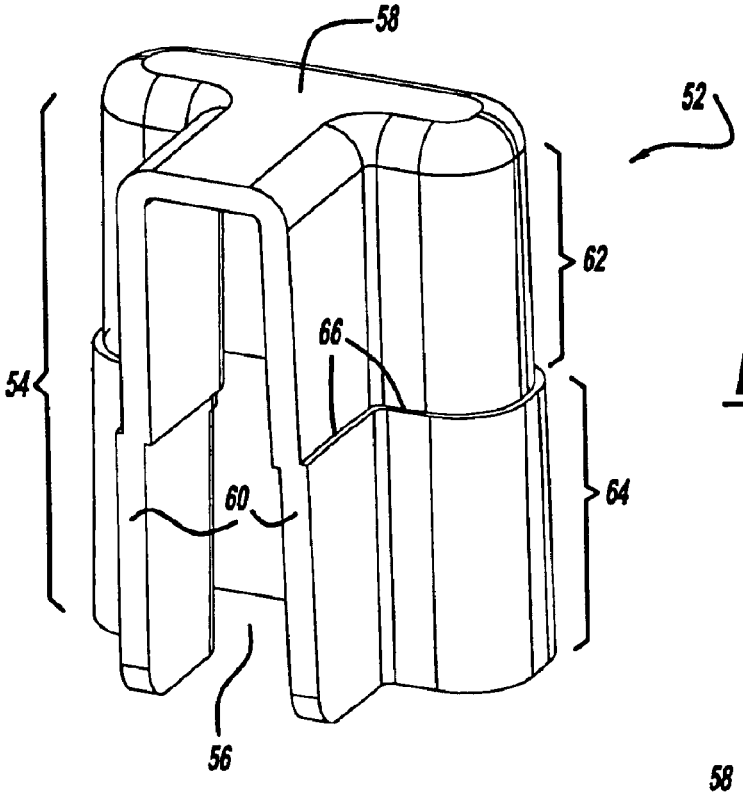
FIG. 10 is a front, upper perspective view of a connector for securing the ramp modules together when stacked vertically.
Figure 11:
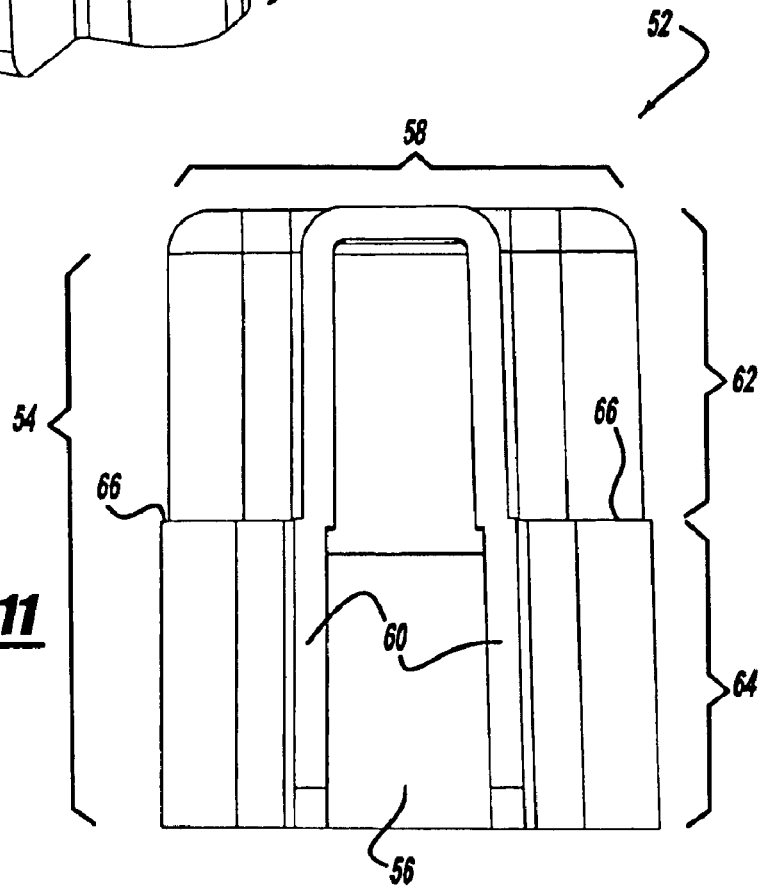
FIG. 11 is a front elevational view of the connector of FIG. 10.

In order to secure the different ramp modules together for vertical stacking a separate connecting member is provided. Looking now to FIGS. 10 and 11 a connector 52 is shown and is of a generally open structure having an inner substantially enclosed portion 54 having an opening 56 at its lower end and a closed cap portion 58 at its upper end. A generally U-shaped, open flanged, channel 60 extends outwardly from the forward side. The connector 52 has an upper section 62 and a lower section 64. The lower section 64 is somewhat larger transversely than the upper section 62 to define an outer alignment and stop ridge 66 which serves a purpose to be described.

The T-shaped connecting protrusions, such as 22*a*, 24*a*, and T-shaped channel grooves, such as 26*a*, 28*a*, are uniquely constructed for connecting the inclined ramp modules 12 and straight ramp modules 14 together, side-by-side or end-to-end. At the same time the connectors 52, T-shaped protrusions and T-shaped channel grooves are uniquely constructed for providing connections between the inclined ramp modules 12 and straight ramp modules 14 for vertical stacking.

All of the T-shaped projections and T-shaped channel grooves are of an identical configuration and construction except for the shortened T-shaped protrusions 22*a, b* and 24*a, b* and shortened T-shaped channel grooves 26*a, b* and 28*a, b* on the side walls 18*a*, 18*b* of the inclined ramp modules 12. However, the configuration of the shortened T-shaped projections and T-shaped grooves are the same as the corresponding lower portions of the full length T-shaped projections and T-shaped grooves.

Figure 15:
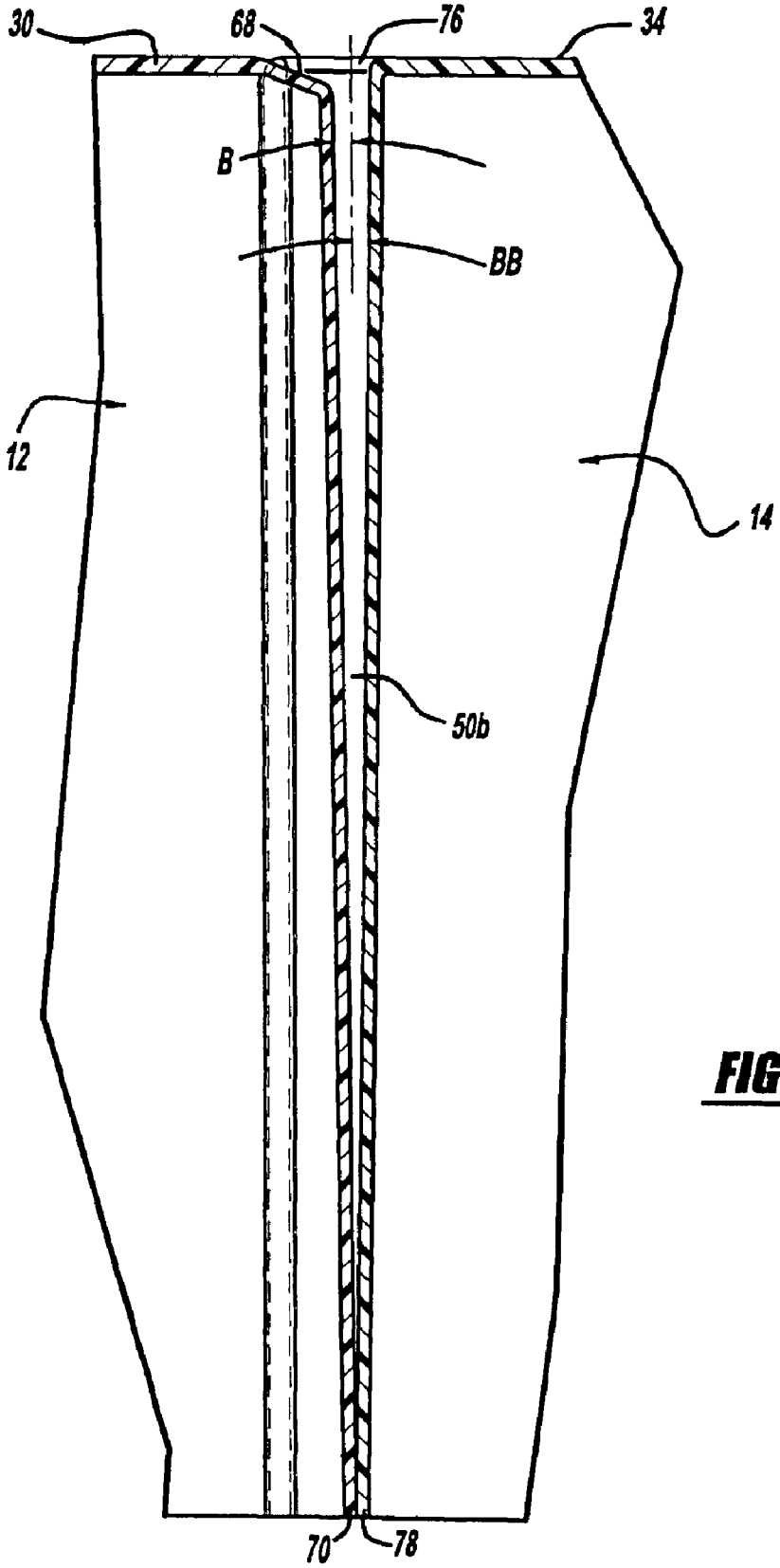
FIG. 15 is a fragmentary vertical sectional view to enlarged scale of the confronting surfaces of the T-shaped protrusion of the lower inclined ramp module and the T-shaped groove of the adjacent lower straight module of FIG. 2 when connected together and taken generally along the line and in the direction of the Arrows 15—15 in FIG. 2, with the section line in the direction of Arrows 15'—15' in FIG. 2 providing a view which would be a mirror image of FIG. 15 and thus that view has been omitted for purposes of simplicity.
Figure 16:
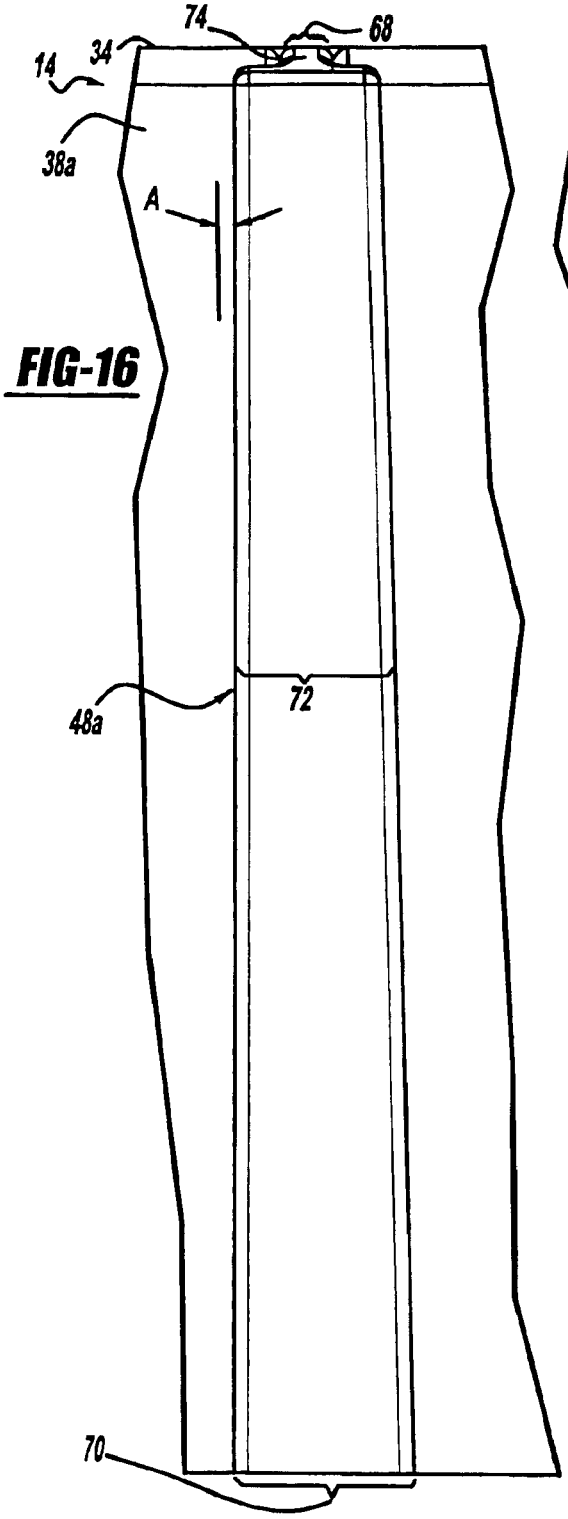
FIG. 16 is a fragmentary view to enlarged scale of the T-shaped connecting protrusion of the straight ramp module of FIG. 8 taken generally in the Circle 16 in FIG. 8.
Figure 17:
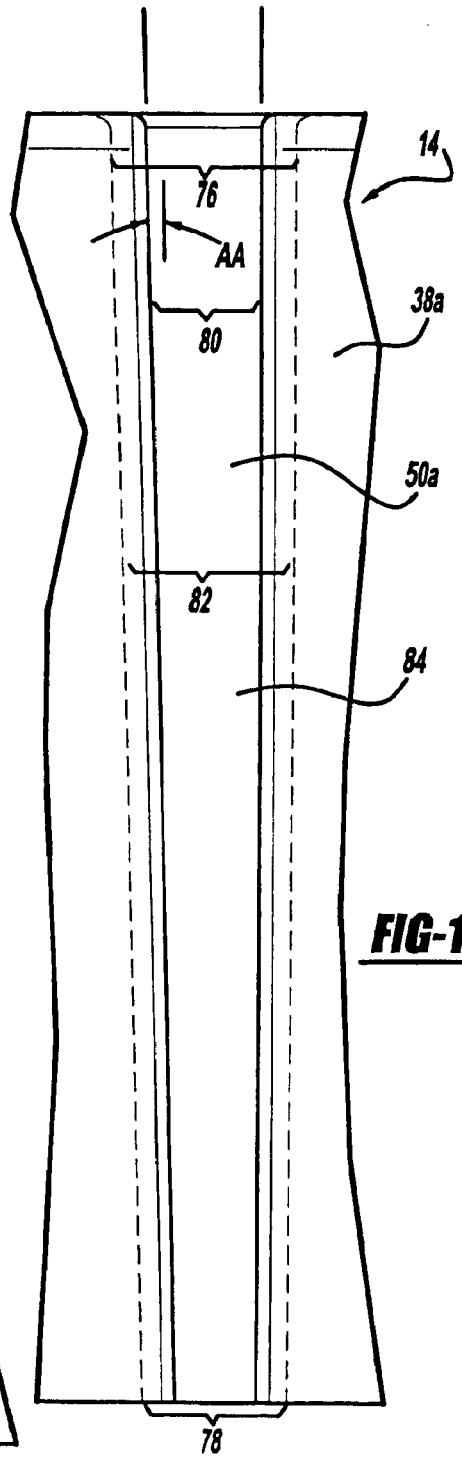
FIG. 17 is a fragmentary view to enlarged scale of the T-shaped connecting groove of the straight ramp module of FIG. 8 taken generally in the Circle 17 in FIG. 8.

A representative example of the structure of the full length T-shaped protrusions and T-shaped channel grooves can be seen in FIG. 16 which is of the T-shaped protrusion 48*a* and FIG. 17 which is of the T-shaped channel groove 50*a*. These views are taken from FIG. 8 which, as can be seen, is at the front end wall 38*a* of the straight ramp module 14. Other features of the T-shaped protrusions 48*a* and of the T-shaped channel groove 50*a* can be seen in FIGS. 12, 15, 18 and 19.

Figure 12:
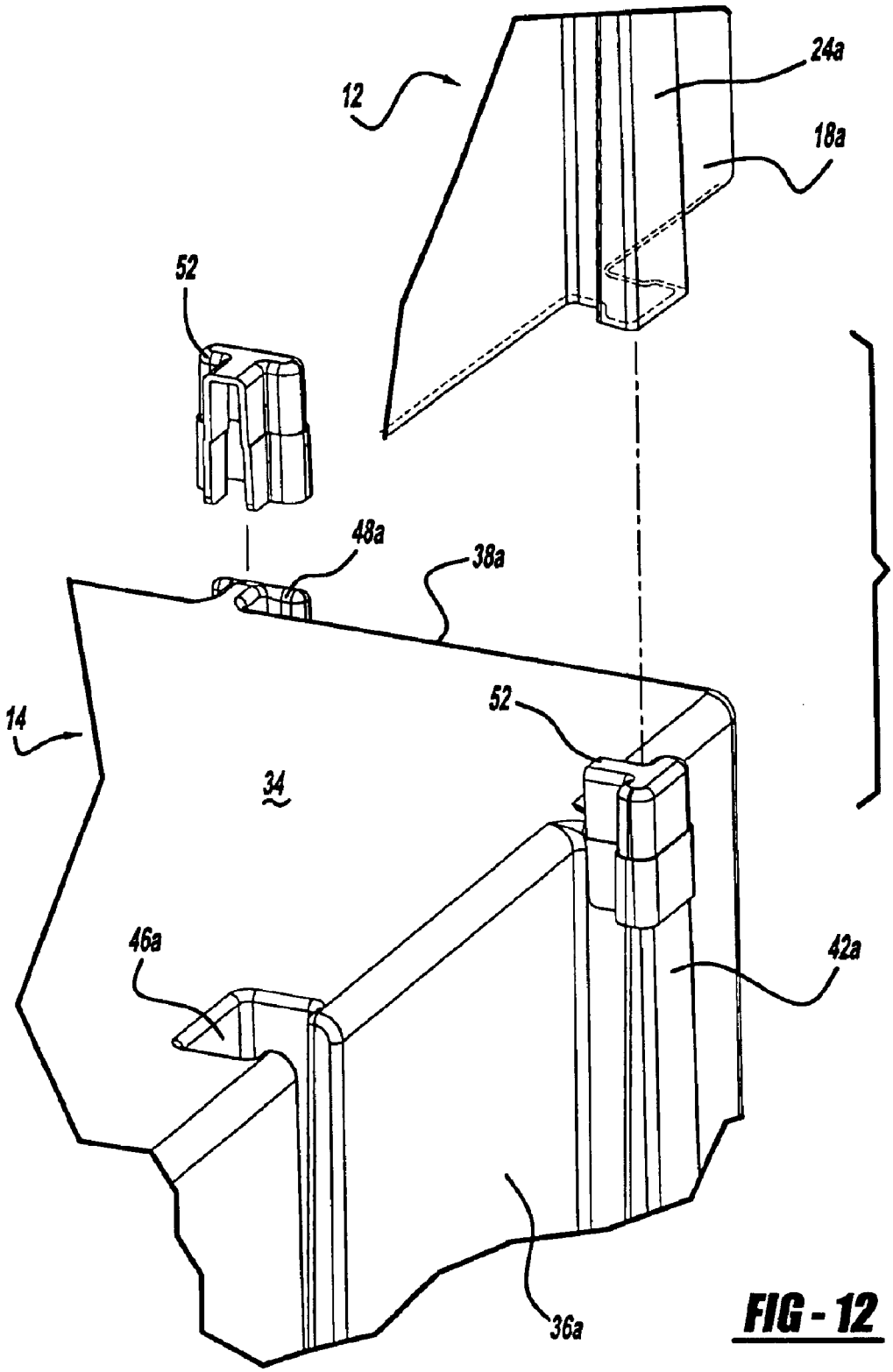
FIG. 12 is an exploded, fragmentary view showing the layered connection prior to assembly between a straight ramp module on the bottom and an inclined ramp module on top with connectors of FIGS. 10 and 11 for securing the ramp modules together.
Figure 18:
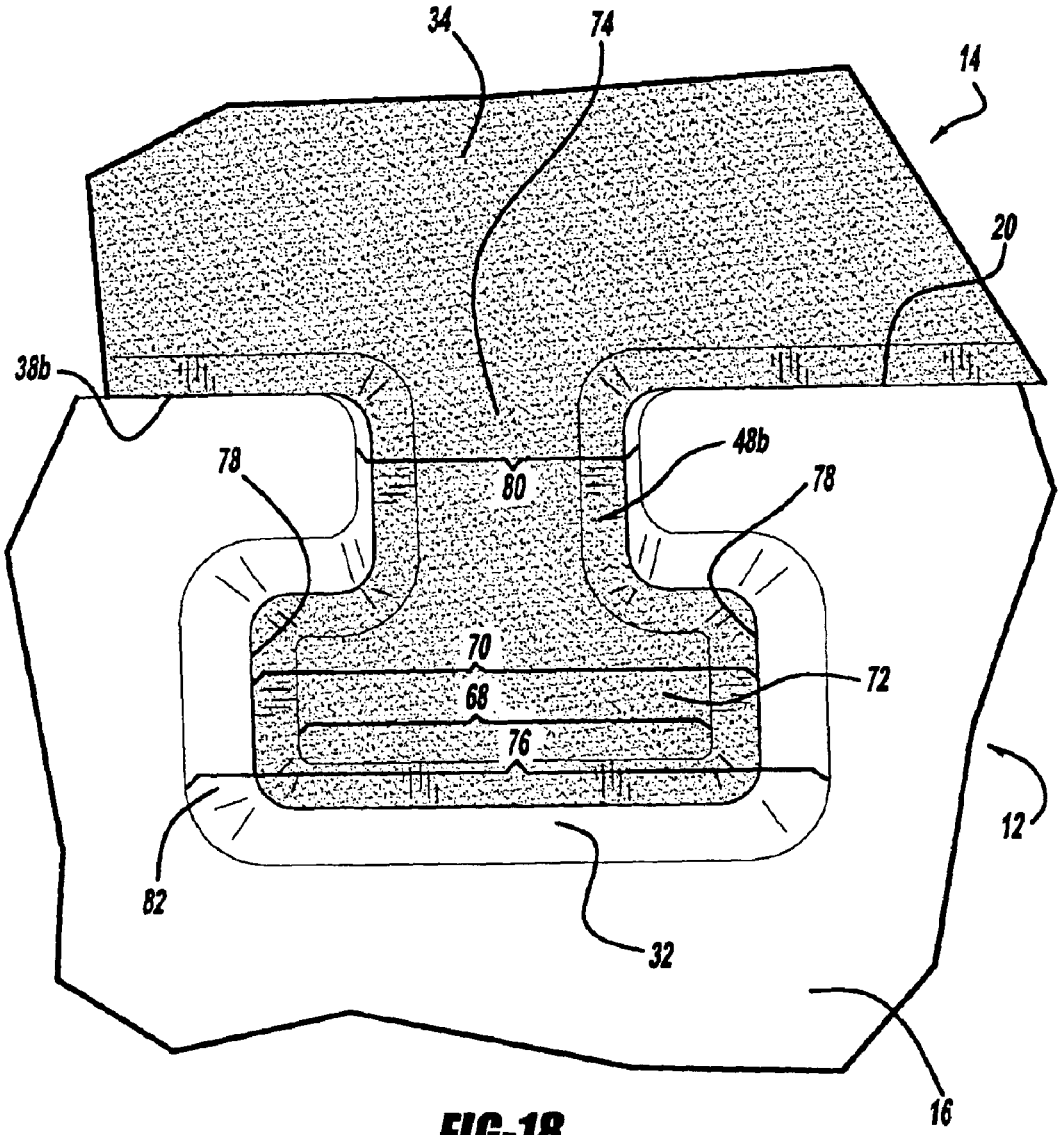
FIG. 18 is a fragmentary view to enlarged scale taken generally vertically downwardly in the direction of the Arrows 18—18 in FIG. 2 depicting the upper end of the connection between a T-shaped connecting protrusion on the straight ramp module and a T-shaped connecting groove on the inclined ramp module.
Figure 19:
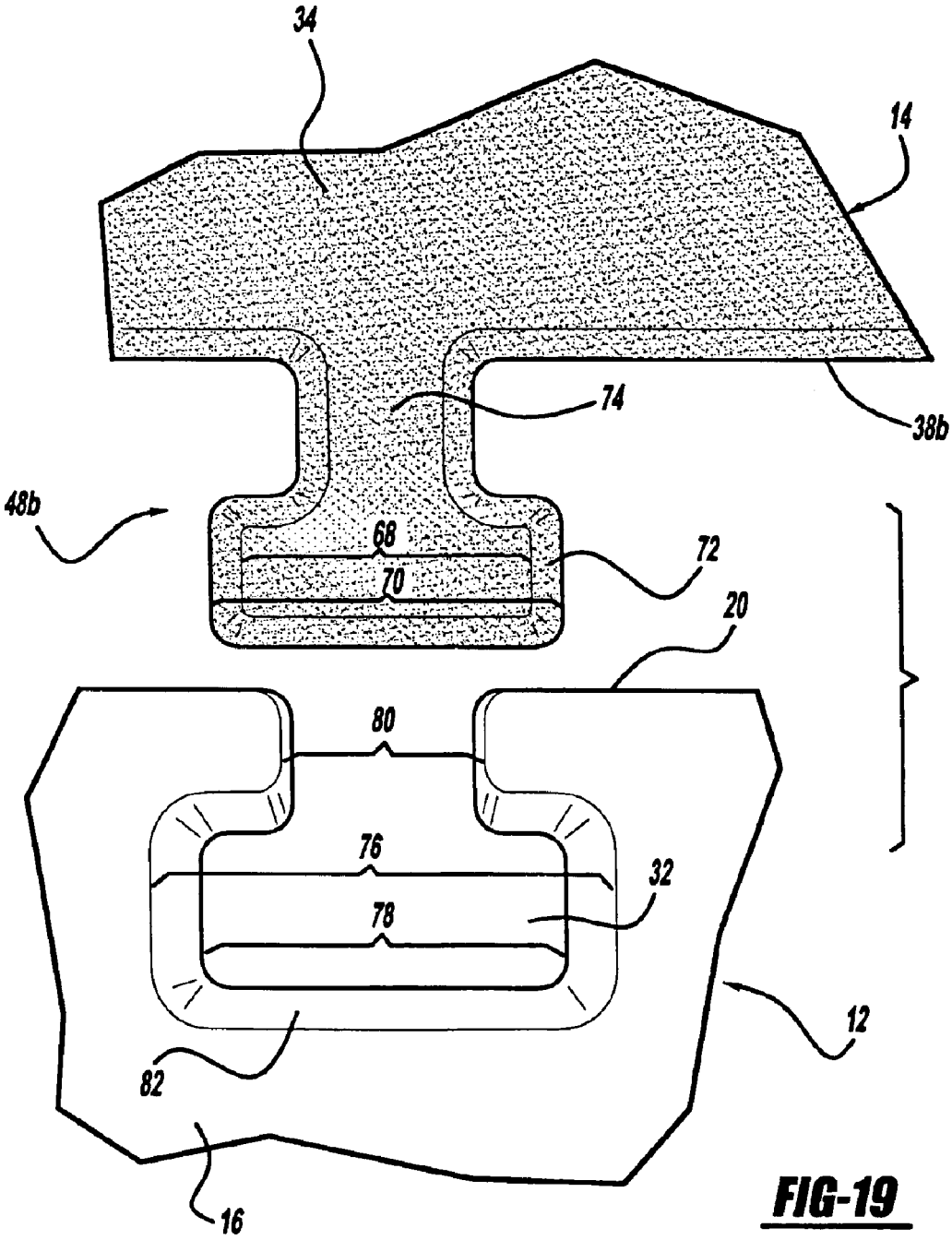
FIG. 19 is a fragmentary view depicting the T-shaped protrusion and T-shaped groove of FIG. 18 separated prior to assembly.

Looking now to FIGS. 16, 18 and 19 the T-shaped protrusion 48*a* is of a tapered construction with a narrower upper end 68 tapering to a wider lower end 70. The protrusion 48*a* has an outer rectangular section 72 connected to the end wall 38*a* by a narrower neck section 74. The rectangular section 72 and neck section 74 are similarly tapered and in one form of the invention the taper angle A was selected to be around 1.5°. As can be seen in FIG. 12, the protrusion 48*a* is of a hollow construction with the neck section 74 opening into the generally hollow interior of the straight ramp module 14. The T-shaped protrusion 48*a* is closed at the upper end 68 and open at the lower end 70. In this regard, the shorter T-shaped protrusions on the side walls 18*a* and 18*b* of the inclined ramp module 12 are also hollow and closed at their upper ends as can be seen with the T-shaped protrusion 24 in FIG. 5.

Looking now to FIGS. 17, 18 and 19, the T-shaped channel groove 50*a* is also of a tapered construction but which is of a reverse taper relative to that of the T-shaped protrusion 48*a*. Thus the channel groove 50*a* tapers from a wider upper end 76 to a narrower lower end 78. The T-shaped channel groove 50*a* has an outer, slotted narrow neck section 80 connected to a wider inner rectangular groove section 82. The rectangular groove section 82 is closed at its inner surface 84 whereby the channel groove 50*a* is not open to the hollow interior of the straight ramp module 14. As can be seen in FIG. 17, the neck section 80 and rectangular groove section 82 are similarly tapered at an angle AA of around 1.5° which is thus substantially the same as the reverse taper angle A of the T-shaped protrusion 48*a*.

Looking now to FIGS. 18 and 19, the size of the T-shaped protrusion 48*a* at its wider lower end 70 is substantially the same as the size of the T-shaped channel groove 50*a* at its narrower lower end 78 to provide mating engagement at the location. However, the size of the narrower upper end 68 of the T-shaped protrusion 48*a* is less than the size of the wider upper end 76 of the T-shaped channel groove 50*a* to provide a preselected clearance for a purpose to be seen.

FIG. 15 shows the vertical relationship of the T-shaped protrusion 48*a* when interconnected into the T-shaped channel groove 50*b*. Here it can be seen that the outer rectangular section 72 is angled inwardly lengthwise from the lower end 70 to the upper end 68 at an angle B. The inner surface 84 of the rectangular groove section 82 of the T-shaped groove 50*a* is also angled inwardly lengthwise from the lower end 78 to the upper end 76 at angle BB. Here in one form of the invention the angle B was set at around 0.75° while the angle BB was also set at around 0.75°. This provides a preselected clearance at the upper ends 68, 76 while the lower ends 70, 78 are in mating engagement.

The noted clearances facilitate assembly of the ramp modules together for horizontal in-line connection, i.e. end-to-end, side-to-side or end-to-side. The clearance also facilitates assembly of the ramp modules in a variety of vertically stacked relationships. In addition while the tapers and inclinations of the T-shaped protrusions 48*a* and T-shaped channel grooves 50*a* facilitate assembly they also facilitate manufacture by assisting in ejection of the modules from the molds in the molding process.

Figure 13:
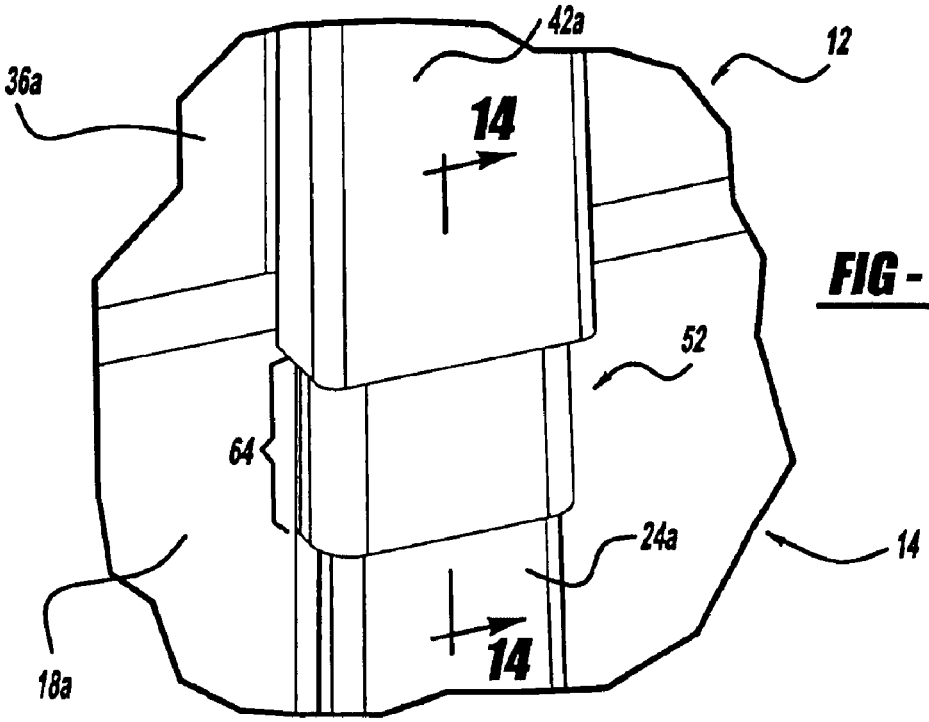
FIG. 13 is a fragmentary pictorial view to enlarged scale taken generally in the Circle 13 in FIG. 1 and showing the layered connection of a straight ramp module on the bottom and an inclined ramp module stacked on top of the straight ramp module and secured together with the connector of FIGS. 10 and 11.
Figure 14:
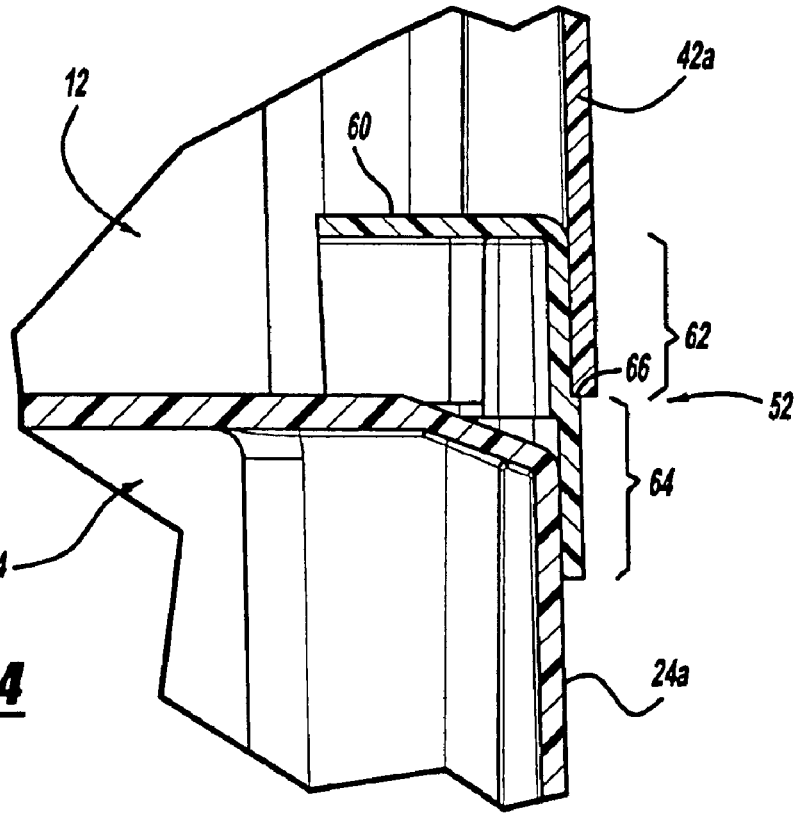
FIG. 14 is a fragmentary sectional view of the layered connection between the straight and inclined ramp modules by the connector of FIGS. 10 and 11 taken generally along the line and in the direction of the Arrows 14—14 in FIG. 13.

As noted in order to securely stack one ramp module upon another, the connectors 52 are used. This can be seen in FIGS. 12–14 where an inclined ramp module 12 is being stacked upon a straight ramp module 14. First each of the connectors 52 is located over the upper end 68 of the T-shaped protrusions such as protrusions 42*a* and 48*a*. Here the lower section 64 of the connector 52 will fit snugly on the upper end 68. With the connectors 52 in place next the inclined ramp module 12 is placed on top of the straight ramp module 14 with the T-shaped protrusion 24*a* on the side wall 18*a* and protrusion 30 on the end wall 20 in line with the T-shaped protrusion 42*a* on the side wall 36*a* and the T-shaped protrusion 48*a* on the front end wall 38*a*. The opening at the lower end 70 of the T-shaped protrusion 48*a* is of a contour to move over the upper section 62 of the connector 52 with the bottom side of the lower end 70 of the T-shaped protrusion 48*a* engaging the outer stop ridge 66. The inclined ramp module 12 is pressed downwardly until the bottom of the inclined ramp module 12 engages the straight, planar upper riding or support surface 34 of the straight ramp module 14.

Where the vertical stacking is an inclined ramp module 12 on a straight ramp module 14, connectors 52 will be applied to the T-shaped protrusions on both side walls 36*a*, 36*b* and the front end wall 38*a*. Where a straight ramp module 14 is stacked on top of another straight ramp module 14, then connectors 52 will be applied to each of the T-shaped protrusions on both side walls 36*a*, 36*b* and both end walls 38*a*, 38*b*.

In the event, it is desired to double the width of the ramp assembly 10, a second straight ramp module 14 will first be secured side-by-side to the first straight ramp module 14 with the opposite side wall 36*b* located next to the side wall 36*a*. Here the T-shaped protrusions 40*a*, 42*a* will be connected with the T-shaped grooves 44*b*, 46*b* and the T-shaped grooves 44*a* and 46*a* will be connected with the T-shaped protrusions 40*b*, 42*b*. Now the connectors 52 will be located over the T-shaped protrusions 40*a*, 42*a* and in a generally clearance fit in the related T-shaped grooves 44*b*, 46*b*. The clearance between the upper end of a T-shaped protrusion 48*b* and the upper end of a T-shaped groove 32 can be readily seen in FIGS. 18 and 19. Now the inclined ramp module 12 will be assembled onto the first straight ramp module 14, as noted. Next a second inclined ramp module 12 will be placed on top of the second straight ramp module 14 with the T-shaped protrusions 22*b*, 24*b* on side wall 18*b* located in the T-shaped grooves 26*a*, 28*a* on side wall 18*a* and also with the T-shaped protrusions 22*a*, 24*a* on the side wall 18*a* located in the T-shaped grooves 26*b*, 28*b* on the side wall 18*b*. In addition further stacked connection could be provided between the side-to-side surfaces utilizing connectors 52 between the T-shaped protrusion 40*b* and 42*b* on the straight ramp module 14 and the T-shaped protrusions 22*b* and 24*b* on the inclined ramp module 12. It can be seen, however, that the straight ramp module 14 can be connected side-by-side with two side walls 36*a* or two side walls 36*b* connected together by simply rotating the second ramp module 14 by 180°. This will bring the T-shaped protrusions 22*a*, 24*a* and the T-shaped grooves 26*a*, 26*b* on the second side wall 18*a* in alignment with the T-shaped grooves 26*a*, 26*b* and T-shaped protrusions 22*a*, 24*a* on the first side wall 18*a*. The same versatility is true in connecting one end wall 38*a* to another end wall 38*a* or 38*b* to 38*b* for end-to-end connection.

As can be seen from FIGS. 1 and 2, the ramp system of the present invention permits the user to create ramp assemblies of varying configurations. An example of one such ramp assembly 10 is shown in FIG. 1. Here a first inclined ramp module 12 is connected end-to-end with a first straight ramp module 14 at ground level. This is done simply by slidably moving the T-shaped protrusion 48*b* on the end wall 38*b* into the T-shaped channel groove 32 on the end wall 20 and at the same time moving the T-shaped channel groove 50*b* on the end wall 38*b* over the T-shaped protrusion 30 on the end wall 20. In this regard a similar connection could be made with the end wall 38*a*. Next the overall length can be extended by connecting a second straight ramp module 14 end-to-end with the first straight ramp module 14 at ground level. This is done similarly to the above by placing the T-shaped protrusion 48*b* on the rear end wall 38*b* into the T-shaped channel groove 50*a* on the front end wall 38*a* and slidably moving the T-shaped channel groove 50*b* on the rear end wall 38*b* over the T-shaped protrusion 48*a* on the front end wall 38*a*.

Now a second inclined ramp module 12 is placed on the upper riding or support surface 34 on the first straight ramp module 14. These stacked ramp modules 12 and 14 are then connected together by use of the connectors 52. Looking now to FIGS. 10–12, connectors 52 are located over the upper ends of the T-shaped protrusions 40*a, b* and 42*a, b* on the side wall 36*a* of straight ramp module 14 and on the T-shaped protrusion 48*a* on the front end wall 38*a*.

Now to extend the height of the ramp assembly 10 as shown a third straight ramp module 14 is located on the planar upper support surface 34 of the second straight ramp module 14. As this is done the T-shaped channel groove 50*b* and T-shaped protrusion 48*b* on the rear end wall 38*b* of the second straight module 14 are interconnected with the T-shaped protrusion 30 and T-shaped channel groove 32 on the front end wall 20 of the second inclined module 12. At the same time connectors 52 have already been located on the upper ends of the T-shaped protrusions 40*a, b* and 42*a, b* of the second straight module 14 and are moved into the lower ends of the aligned T-shaped protrusions 40*a, b* and 42*a, b* on the third straight module 14. This is done by moving the lower or bottom end of the T-shaped protrusions 40*a, b* and 42*a, b* over the upper section 62 of the connectors 52 against the outer stop ridge 66.

Now the assembly 10 is completed by locating a third inclined ramp module 12 on the planar upper support surface 34 of the third straight ramp module 14. Again the connectors 52 are first located over the upper ends of the T-shaped protrusions 40*a, b* and 42*a, b* and the T-shaped protrusions 22*a*, b and 24*a, b* are located over the upper section 62 of the connectors 52 to secure the modules together.

The outer edge of the riding or support surface 16 at the end wall 20 of the inclined ramp modules 12 and the outer edges of the riding or support surface 34 at the end walls 38*a, b* of the straight ramp modules 14 are arcuately formed to avoid stress. Such arcuate outer edges 86 and 88 are shown in FIG. 1*a*. In order to cover the slight gap between the adjacent edges 86 and 88 at the juncture of the end walls 20 and 38*b*, the inclined riding or support surface 16 of the inclined module 12 is provided with a somewhat flexible, generally tapered lip 90 at its lower, front end. This provides for a relatively smooth transition between the two adjacent inclined support surfaces 16 on the lower and upper inclined ramp modules 12 so as to render the gap between the adjacent edges 86 and 88 substantially imperceptible to the user.

FIG. 2 shows examples of the variety of horizontal and vertical interconnections between the inclined ramp modules 12 and straight ramp modules 14 to provide a selective variety of modular ramp assemblies generally indicated by the numeral 10'. As noted a number of the inclined ramp modules 12 and straight modules 14, are shown in phantom to indicate the variety of interconnections for different ramp assemblies. Thus the same end user can have the versatility of setting up ramp assemblies of different configurations for different objectives and even different uses, i.e. inline skates, skateboards, etc. This then allows the user to set up ramp assembly obstacle courses with different degrees of challenge.

Both the inclined upper riding or support surface 16 on the inclined ramp module 12 and the straight planar upper riding or support surface 34 on the straight ramp module 14 can be roughened to enhance gripping of the engaging rolling member such as bike tires, skate rollers, etc. and to assist in traction and to inhibit slippage especially if wet. In one form, the roughened surfaces were formed in molding. However, it should be understood that such roughened surfaces could be created after molding. In this regard, it can be seen in FIG. 7 that in some forms of a ramp assembly the planar upper support surface 34 of at least one straight ramp module 14 will be exposed for engagement by the rolling member. For purposes of simplicity of the drawings only the inclined ramp module 12 in FIGS. 3 and 4 and straight ramp module 14 in FIG. 7 are shown with roughened surfaces.

As noted, both the inclined ramp modules 12 and straight ramp modules 14 are of a hollow construction and as such are designed to be molded from a plastic material. In one form of the invention the plastic material was a high density polyethylene (HDPE). In this regard, the connectors 52 can be molded from the same material.

In order to facilitate molding of the inclined ramp modules 12 and straight ramp modules 14 and to provide modules that are relatively light weight, a hollow structure is provided with numerous internal ribs.

Such a structure for the inclined ramp module 12 can be seen in the longitudinal section of FIG. 3*a*. There, a plurality of longitudinally extending main ribs 92 connect the inclined riding or support surface 16 with the end wall 20. Only one rib 92 is shown for purposes of simplicity. At the same time a plurality of transverse main ribs 94 are connected between the inclined support surface 16, the side walls 18*a*, 18*b*, and the longitudinal ribs 92. The center portions of the ribs 92 and 94 are of a reduced vertical length while the sides extend to the bottom.

Figure 7A:
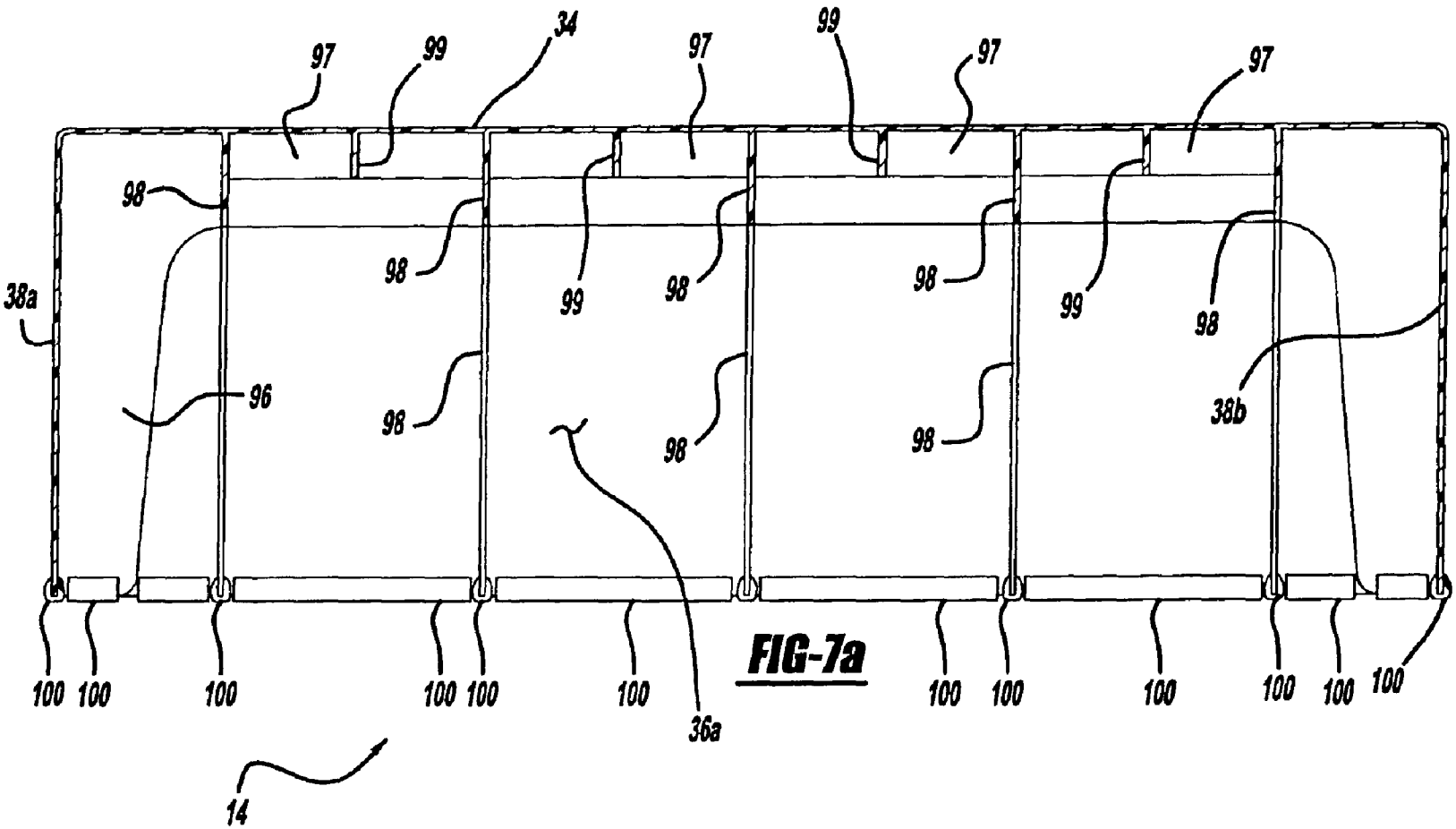
FIG. 7*a* is a longitudinal sectional view along the length of the straight ramp module of FIG. 7 and taken generally along the line and in the direction of the Arrows 7*a*—7*a* in FIG. 7.
Figures 7B, 7C, 7D:
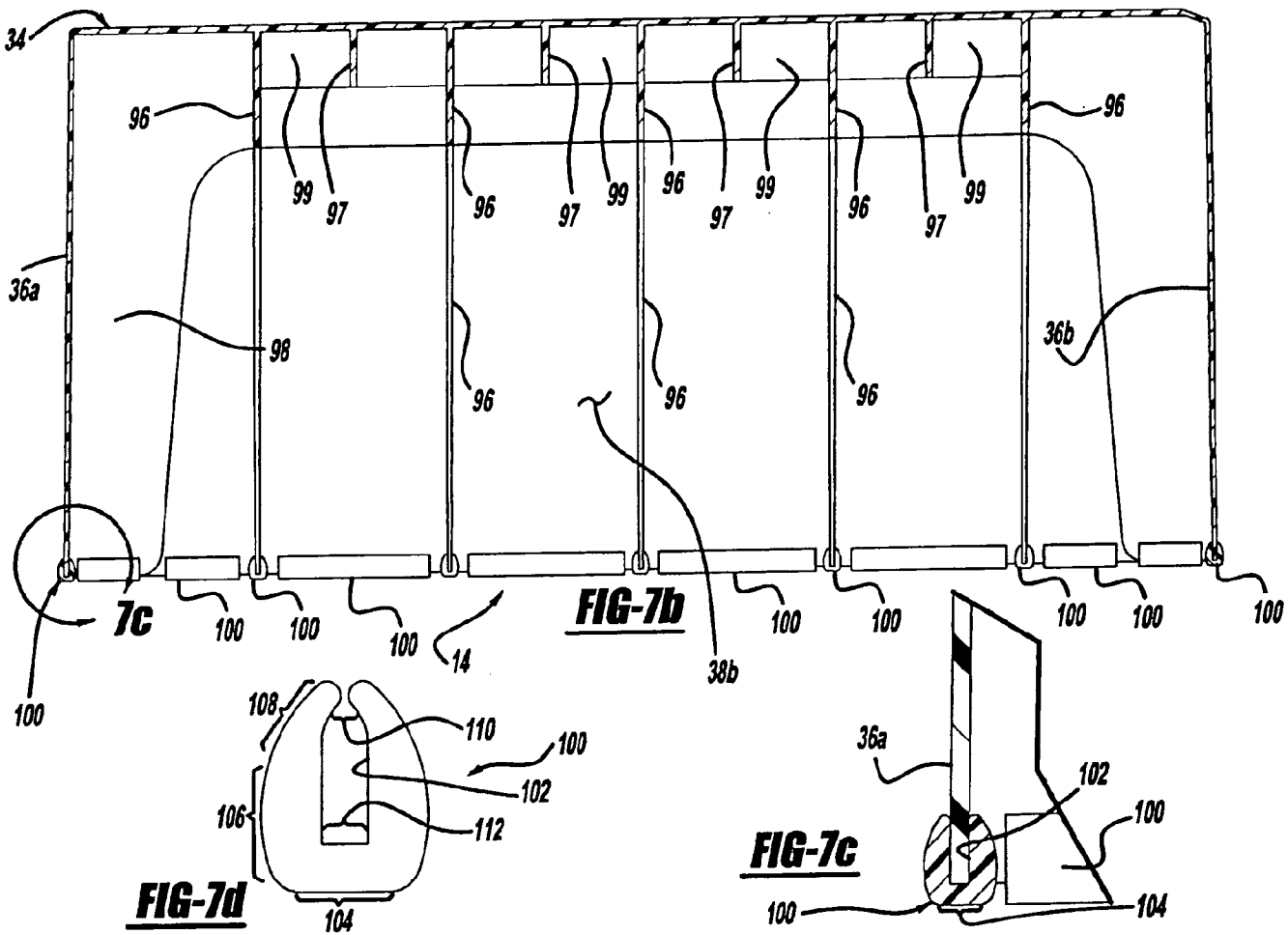
FIG. 7*b* is a transverse sectional view along the width of the straight ramp module of FIG. 7 and taken generally along the line and in the direction of the Arrows 7*b*—7*b* in FIG. 7.
FIG. 7*c* is an enlarged, fragmentary sectional view of a bottom portion of the straight ramp module of FIG. 7 taken generally in the Circle 7*c* in FIG. 7*b* depicting the slip resistant foot member as applied to the bottom end of one of the side walls of the straight ramp module.
FIG. 7*d* is an enlarged end elevational view of the foot member of FIG. 7*c;*

The internal structure for the straight ramp module 14 can be seen in FIGS. 7*a* and 7*b*. FIG. 7*a* shows a plurality of longitudinally extending main ribs 96 which connect the riding or support surface 34 with end walls 38*a, b*. FIG. 7*b* shows a plurality of transversely extending main ribs 98 which connect the support surface 34 with the side walls 36*a, b* and are interconnected with the longitudinal ribs 96. Again the center portions of the ribs 96 and 98 are of a reduced vertical length while the sides extend to the bottom. These structures facilitate the molding process and the production of the inclined modules 12 and straight module 14 of a lightweight structure.

In one form of the invention the inclined module 12 and straight module 14, generally of the construction noted, each has five generally equally spaced longitudinal main ribs 92 and 96, respectively, and five generally equally spaced transverse main ribs 94,98, respectively. As noted the longitudinal main ribs 92 and 96 extend for substantially the full length of the ramp modules 12 and 14 while the transverse main ribs 94 and 98 extend for substantially the full width of the ramp modules 12 and 14. In addition, the inclined module 12 has four longitudinal rib segments 93 in between the five longitudinal main ribs 92 and four transverse rib segments 95 in between the five transverse main ribs 94. The rib segments 93 and 95 are also connected to the support surface 16 but do not extend for the full length or full width of the inclined ramp module 12. Similarly, each of the straight ramp modules 14 has four longitudinal rib segments 97 In between the five longitudinal main ribs 96 and four transverse rib segments 99 in between the five transverse main ribs 98. The rib segments 97 and 99 are also connected to the planar support surface 34 but which do not extend for the full length or full width of the straight ramp module 14.

As can be seen the overall strength and rigidity of the riding or support surfaces 16 and 34 are thereby substantially enhanced. Also it can be seen that the outer lower ends of the main ribs 92 and 94 of the inclined ramp module 12 and the main ribs 96 and 98 of the straight ramp module 14 extend to the bottom of the respective ramp modules 12 and 14. These then provide a distributed support surface against the ground or when engaged with the riding or support surfaces 34 when in a stacked condition.

In this regard, in one form of the invention the inclined modules 12 and straight modules 14 where made with side walls 18*a, b* and 36*a, b* of the same longitudinal length (Li, Ls), and end walls 20 and 38*a, b* of the same transverse width (Wi, Ws), and of the same vertical height (Hi, Hs). As such in one form, the longitudinal length (Li, Ls), was around 36 inches, the transverse width (WI, Ws) was around 25.5 inches and the vertical height (Hi, Hs) was around *12* inches. In this regard, the tapered lip 90 extends longitudinally slightly past the length Li of side walls 18*a, b* at the lower end to provide the desired coverage of the gap between the confronting edges 86 and 88 of the adjacent end walls 20 and 38*b*. Also in this form the angle of inclination AI of the riding or support surface 16 of the inclined module 12 was selected to be around 19°. With such a structure the support surfaces 16 and 34 and main ribs 92, 94, 96 and 98 could be made of a relatively small gauge or thickness. As such the support surfaces 16 and 34 could be made around 0.140 inches thick; the side walls 18*a, b* and 36*a, b* and end walls 20 and 38*a, b* could be made around 0.100 inches thick; and the main ribs 92, 94, 96 and 98 could be made around 0.060 inches thick. The rib segments 93, 95,97 and 99 could be of the same thickness as the main ribs 92, 94, 96 and 98. Some of the above structures would be somewhat slightly tapered to facilitate molding. Such hollow, relatively thin wall constructions can produce generally lightweight ramp modules, i.e. around 17 pounds for the straight module 14 and around 11 pounds for the inclined module 12. Yet it is believed that the constructions as noted can safely handle loads at least up to 300 pounds.

In order to provide resistance to slippage on the ground level a foot member can be provided to be selectively placed on portions of the bottom ends of the side walls 18*a, b* and 36*a, b* and the end walls 20 and 38*a, b*. Such a foot member 100 can be seen in FIG. 7*c* as applied to side wall 36*a* and in FIG. 7*d* prior to application to a side wall 36*a*. Here the foot member 100 is provided of a generally U-shaped cross-section having an open channel 102 which is of a size to be snugly located on the bottom end of the outer side walls and outer end walls of the inclined ramp modules 12 and straight ramp modules 14 of a ramp assembly.

Looking now to FIG. 7*d* the U-shaped foot member 100 has a substantially wider bottom engagement segment 104 to provide a desired amount of surface contact with the surface on which the ramp assembly 10 is located to inhibit slippage. The foot member 100 has a lower section 106 which is of a generally uniform wall thickness and is connected to an upper tapered section 108 of varying reduced wall thickness. At the same time an upper open end 110 of the foot member 100 is partially closed while the lower end 112 is of a width substantially the same as the wall thickness of the outer side walls 18*a, b* and 36*a, b* and outer end walls 36*a, b*. Thus the foot member 100 can be resiliently moved through the open end 110 onto the outer side walls 18*a, b* and 36*a, b* and end walls 38*a, b* with the upper section 108 closing to grip the side walls and end walls to assist in retaining the foot member 100 in place. In addition the foot member 100 can also be applied to the outer lower ends of the main ribs 92, 94, 96 and 98. In this regard, the main ribs 92, 94, 96 and 98 are of a lesser thickness than that of the side walls 18*a, b* and 36*a, b* and end walls 20 and 38*a, b*. This will provide a clearance with the lower end 112 of the channel 102. However, the open end 110 of the foot member 100 will still be moved apart resiliently upon application over the main ribs 92, 94, 96 and 98 and will be closed to grip the main ribs 92, 94, 96 and 98 to retain the foot member 100 in place. The foot member 100 is also made of a generally resilient, elastic material such as an EPDM rubber of around 75 to around 80 durometer whereby discontinuities in the ground supporting surface can also be substantially accommodated. The foot member 100 can be simply made of strips which can be cut to preselected limited lengths to fit the accessible portions at the bottom ends of the outer side walls 18*a, b* and 36*a, b* and outer end walls 38*a, b*. It could also be applied to the end wall 20 only where a single inclined ramp module 12 is used alone. In one form, the engagement segment 104 was made around 0.30 inches wide. For purposes of simplicity the foot member 100 is shown only applied to the straight ramp module 14 in FIGS. 7*a* and 7*b*. It should be understood that the foot member 100 may not need to be applied to each of the multiple locations as shown. It should be noted that even where the foot member 100 is not applied to the main ribs 92, 94, 96 and 98, there could still be ground contact by the lower ends of the main ribs when riding load is being applied as the foot member 100 elastically deforms.

Thus it can be seen that the ramp assemblies of various configurations can be readily assembled and disassembled by vertical sliding movement to engage or disengage the T-shaped protrusions from the T-shaped channel grooves and a simple type of action for stacking or unstacking the ramp modules.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an upper support surface which is inclined for substantially its full engageable riding length and is supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said end wall of said inclined ramp module and said end walls of said straight ramp module having substantially the same transverse width and substantially the same vertical height and with said side walls of said inclined rams module and said side walls of said straight ramp module having substantially the same longitudinal length, said transverse width of said end walls of said straight and inclined ramp modules being no greater than said longitudinal length of said side walls of said straight ramp module.

2. The ramp system of claim 1 with said bottom side of said straight ramp module adapted to be supported on said planar support surface of another of said straight ramp modules in a stacked relationship.

3. The ramp system of claim 1 with either of said end walls at the ends of said straight ramp module adapted to be secured to the opposite end wall of another of said straight ramp modules and to said end wall of said inclined ramp module for end-to-end assembly with connecting means integrally formed on each of said end walls and adapted to interengage each other to secure said ramp modules together.

4. The ramp system of claim 1 wherein said inclined and straight upper support surfaces being of a substantially uniform contour and having a textured, roughened finish to inhibit slippage.

5. The ramp system of claim 1 wherein said ramp modules of at least two different configurations are made from a high density plastic such as a high density polyethylene.

6. The ramp system of claim 1 wherein the angle of inclination of said inclined upper support surface on said inclined ramp module is about 19°, said end wall of said inclined ramp module and said end walls of said straight ramp module each having a transverse width of around 25.5 inches and vertical height of around 12 inches, said side walls of said inclined ramp module and said side walls of said straight ramp module having a longitudinal length of around 36 inches.

7. The ramp system of claim 1 with said inclined ramp module being of a generally hollow structure with said triangularly shaped side walls and end wall being of a relatively thin wall thickness, the lower extremities of said triangularly shaped side walls and end wall defining the bottom side of said inclined ramp module, said inclined ramp module having a plurality of longitudinally and transversely extending internal ribs, at least some of said internal ribs having at least a bottom portion extending inwardly and downwardly from said upper surface with substantially no distortion of said upper support surface to substantially the same location as the extremities of said triangularly shaped side walls and said end wall to provide further support for said inclined ramp module at said bottom side, said straight ramp module being of a generally hollow structure with said rectangularly shaped side walls and said end walls at opposite ends being of a relatively thin wall thickness, the lower extremities of said rectangularly shaped side walls and said end walls defining the bottom side of said straight ramp module, said straight ramp module having a plurality of longitudinally and transversely extending internal ribs of a generally thin wall thickness, at least some of said internal ribs having at least a bottom portion extending inwardly and downwardly from said flat upper surface with substantially no distortion of said flat upper support surface to substantially the same location as the extremities of said rectangularly shaped side walls and said end wall to provide further support for said straight ramp module at said bottom side, at least some of said ribs extending inwardly from the bottom of said inclined upper support surface with the contour of said upper support surface being substantially uniformly flat over its length including the area where said some of said ribs extend inwardly from the bottom of said inclined surface.

8. The ramp system of claim 1 with said end wall of said inclined ramp module and said end walls of said straight ramp module constructed to be connected to said side walls of said straight ramp module for end-to-side alignment.

9. The ramp system of claim 1 with said lengths of said inclined ramp module and said straight ramp module being selected such that when one inclined ramp module is connected in end-to-end assembly with one straight ramp module and a second inclined ramp module is supported on said straight ramp module, said inclined upper surfaces of said inclined ramp modules are in angular alignment with substantially no gap between their adjacent ends.

10. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an upper support surface which is inclined for substantially its full engageable riding length and is supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said inclined ramp module and said straight ramp module being of substantially the same length, said inclined ramp module being of a generally hollow structure with said triangularly shaped side walls and end wall being of a relatively thin wall thickness, the lower extremities of said triangularly shaped side walls and end wall defining the bottom side of said inclined ramp module, said upper support surface being substantially uniformly flat over its length, said inclined ramp module having a plurality of generally flat internal ribs extending longitudinally and transversely across the bottom of said flat upper support surface at spaced intervals with substantially no distortion of said flat upper support surface, at least some of said internal ribs having end sections with a bottom portion extending inwardly from said flat upper surface and downwardly to substantially the same location as the extremities of said triangularly shaped side walls and said end wall to provide further support for said flat upper support surface and said side walls and end wall of said inclined ramp module at said bottom side.

11. The ramp system of claim 10 with said straight ramp module being of a generally hollow structure with said rectangularly shaped side walls and said end walls at opposite ends being of a relatively thin wall thickness, the lower extremities of said rectangularly shaped side walls and said end walls defining the bottom side of said straight ramp module, said planar upper surface being substantially uniformly flat over its length, said straight ramp module having a plurality of generally flat internal ribs extending longitudinally and transversely across the bottom of said flat upper support surface at spaced intervals with substantially no distortion of said flat upper support surface, at least some of said internal ribs having end sections with a bottom portion extending inwardly and downwardly from said flat upper surface to substantially the same location as the extremities of said rectangularly side walls and said end walls to provide further support for said flat upper support surface and said side walls and end walls of said straight ramp module at said bottom side.

12. The ramp system of claim 10 including a foot member which is a strip-like generally U-shaped resilient structure adapted to be located on edges on at least one of said bottom side of said inclined ramp module and said bottom side of said straight module for contacting the ground surface to inhibit slippage, said foot member adapted to be applied to the edges on at least one of said lower extremities of said triangularly shaped side walls and to the edges at said bottom portion of said some of said ribs of said inclined ramp module, said U-shaped structure having a channel portion with side sections spaced to accept said edges of varying thickness of said lower extremities of said triangularly shaped side walls and said some of said ribs, said channel portion having an opening at its upper end with said side sections being located proximate to each other to at least partially close said opening and adapted to be resiliently moved apart when said edges are moved into said channel portion and to close to resiliently grip said edges to retain said foot member to said edges.

13. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an upper support surface which is inclined for substantially its full engageable riding length and is supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said inclined ramp module and said straight ramp module being of substantially the same length, said straight ramp module being of a generally hollow structure with said rectangularly shaped side walls and said end walls at opposite ends being of a relatively thin wall thickness, the lower extremities of said rectangularly shaped side walls and said end walls defining the bottom side of said straight ramp module, said planar upper surface being substantially uniformly flat over its length, said straight ramp module having a plurality of generally flat internal ribs extending longitudinally and transversely across the bottom of said flat upper support surface at spaced intervals with substantially no distortion of said flat upper support surface, at least some of said internal ribs having end sections with a bottom portion extending inwardly and downwardly from said flat upper surface to substantially the same location as the extremities of said rectangularly shaped side walls and said end wall to provide further support for said flat upper support surface and side walls and end walls of said straight ramp module at said bottom side.

14. The ramp system of claim 13 including a foot member which is a strip-like generally U-shaped resilient structure adapted to be located on edges on at least one of said bottom side of said inclined ramp module and said bottom side of said straight module for contacting the ground surface to inhibit slippage, said foot member adapted to be applied to the edges on at least one of said lower extremities of said rectangularly shaped side walls and to the edges at said bottom portion of said some of said ribs of said straight ramp module, said U-shaped structure having a channel portion with side sections spaced to accept said edges of varying thickness of said lower extremities of said rectangularly shaped side walls and said some of said ribs, said channel portion having an opening at its upper end with said side sections being located proximate to each other to at least partially close said opening and adapted to be resiliently moved apart when said edges are moved into said channel portion and to close to resiliently grip said edges to retain said foot member to said edges.

15. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, a foot member which is a strip-like generally U-shaped resilient structure adapted to be located on edges on at least one of said bottom side of said inclined ramp module and said bottom side of said straight module for contacting the ground surface to inhibit slippage, said U-shaped structure having a channel portion with side sections spaced to accept said edges of varying thickness, said channel portion having an opening at its upper end with said side sections being located proximate to each other to at least partially close said opening and adapted to be resiliently moved apart when said edges are moved into said channel portion and to close to resiliently grip said edges to retain said foot member to said edges.

16. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an upper support surface which is inclined for substantially its full engageable length and is supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, first attachment means for connecting selected ones of said inclined ramp modules and said straight ramp modules for end-to-end alignment, said first attachment means comprising at least one T-shaped protrusion and at least one T-shaped channel groove both integrally formed on said end wall of said inclined ramp module and on said end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly, matingly moved into said T-shaped channel groove on said one of said ramp modules, said T-shaped protrusions having an attaching structure at their ends which are constructed to be vertically in line when two of said ramp modules are in a stacked assembly, separate connecting means constructed to engage said attaching structures of stacked ramp modules when in line to connect said ramp modules together in the stacked condition.

17. The ramp system of claim 16 including second attachment means for connecting selected ones of said inclined ramp modules and said straight ramp modules for side-by-side alignment.

18. The ramp system of claim 17 with said second attachment means comprising at least one T-shaped protrusion and at least one T-shaped channel groove integrally formed on said triangularly shaped side walls of said inclined ramp module and on said rectangularly shaped side walls of said straight ramp module with the same spacing between each, said T-shaped protrusion on one of said inclined ramp modules adapted to be slidingly, matingly moved into said T-shaped channel groove on another of said inclined ramp modules with said T-shaped protrusion on said another of said inclined ramp modules being slidingly, matingly moved into said T-shaped channel groove on said one of said inclined ramp modules, said T-shaped protrusion on one of said straight ramp modules adapted to be slidingly, matingly moved into said T-shaped channel groove on another of said straight ramp modules with said T-shaped protrusion on said another of said straight ramp modules being slidingly, matingly moved into said T-shaped channel groove on said one of said straight ramp modules.

19. The ramp system of claim 18 with said T-shaped channel grooves and said T-shaped protrusions of said first and second attachment means being equally spaced with said T-shaped protrusions and said T-shaped channel grooves of said first attachment means being operable with said T-shaped protrusions and said T-shaped channel grooves of said second attachment means for connecting selected ones of said inclined ramp modules and said straight ramp modules for end-to-side alignment, the width of said inclined ramp modules being no greater than the length of said straight ramp modules.

20. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, first attachment means for connecting selected ones of said inclined ramp modules and said straight ramp modules for end-to-end alignment, said first attachment means comprising at least one T-shaped protrusion and at least one T-shaped channel groove on said end wall of said inclined ramp module and on said end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly matingly moved into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be located in said small groove section at the lower end of said T-shaped channel groove with a relatively close tolerance fit.

21. The ramp system of claim 20 including second attachment means for connecting selected ones of said inclined ramp modules and said straight ramp modules for side-by-side alignment, said second attachment means comprising at least one T-shaped protrusion and at least one T-shaped channel groove on said triangularly shaped side walls of said inclined ramp module and on said rectangularly shaped side walls of said straight ramp module with the same spacing between each, said T-shaped protrusion on one of said inclined ramp modules adapted to be slidingly, matingly moved into said T-shaped channel groove on another of said inclined ramp modules with said T-shaped protrusion on said another of said inclined ramp modules being slidingly, matingly moved into said T-shaped channel groove on said one of said inclined ramp modules, said T-shaped protrusion on one of said straight, ramp modules adapted to be slidingly, matingly moved into said T-shaped channel groove on another of said straight ramp modules with said T-shaped protrusion on said another of said straight ramp modules being slidingly, matingly moved into said T-shaped channel groove on said one of said straight ramp modules, said T-shaped protrusion having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be in said smaller groove section at the lower end of said T-shaped channel groove with a relatively close tolerance fit.

22. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an upper support surface which is inclined for substantially its full engageable riding length and is supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said inclined ramp module and said straight ramp module being of substantially the, same length, first attachment means for connecting selected ones of said inclined ramp modules and said straight ramp modules for end-to-end alignment and second attachment means for connecting selected ones of said inclined ramp modules and said straight ramp modules for side-by-side alignment, said first attachment means comprising at least one T-shaped protrusion and at least one T-shaped channel groove both integrally formed on said end wall of said inclined ramp module and on said end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly, matingly moved into said T-shaped channel groove on said one of said ramp modules, said second attachment means comprising at least one T-shaped protrusion and at least one T-shaped channel groove both integrally formed on said triangularly shaped side walls of said inclined ramp module and on said rectangularly shaped side walls of said straight ramp module, said T-shaped protrusion on one of said inclined ramp modules adapted to be slidingly, matingly moved into said T-shaped channel groove on another of said inclined ramp modules with said T-shaped protrusion on said another of said inclined ramp modules being slidingly, matingly moved into said T-shaped channel groove on said one of said inclined ramp modules, said T-shaped protrusion on one of said straight, ramp modules adapted to be slidingly, matingly moved into said T-shaped channel groove on another of said straight ramp modules with said T-shaped protrusion on said another of said straight ramp modules being slidingly, matingly moved into said T-shaped channel groove on said one of said straight ramp modules, said T-shaped protrusions having an attaching structure at their ends which are constructed to be vertically in line when two of said ramp modules are in a stacked assembly, separate connecting means constructed to engage said attaching structures of stacked ramp modules when in line to connect said ramp modules together in the stacked condition.

23. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said ramp system being formable in a stacked relationship with a first said inclined ramp module at the entrance at the ground surface connected end-to-end with one said straight ramp module at the ground surface, and including a second inclined ramp module supported on said planar support surface on said straight ramp module with said inclined surfaces of said first and second inclined ramp modules being in line, said ramp system including first attachment means for connecting selected ones of said inclined ramp modules and said straight ramp modules for end-to-end alignment, said first attachment means comprising at least one T-shaped protrusion and at least one T-shaped channel groove on said end wall of said inclined ramp module and on said end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly matingly moved into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be in said small groove section at the lower end of said T-shaped channel groove with a relatively close tolerance fit and with a peripheral gap at the upper ends of said T-shaped protrusion and said T-shaped channel groove, said T-shaped protrusion being open at its lower end, connecting means for connecting said second inclined ramp module to said straight ramp module when in a stacked assembly, said connecting means including a generally T-shaped connector having a T-shaped opening at its lower end, said T-shaped opening adapted to fit over the upper end of the T-shaped protrusion on said straight ramp module, the upper end of said T-shaped connector adapted to fit within the opening at the lower end of said T-shaped protrusion whereby said second inclined ramp module and said straight ramp module will be secured together in the stacked condition.

24. The ramp system of claim 23 with said upper end of said T-shaped connector having a stop portion adapted to engage said lower end of said T-shaped protrusion to provide a preselected, limited amount of movement of said upper end of said T-shaped connector within said lower end of said T-shaped protrusion.

25. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said ramp system being formable in a stacked relationship with a first said inclined ramp module at the entrance at the ground surface connected end-to-end with one said straight ramp module at the ground surface, and including a second inclined ramp module supported on said planar support surface on said straight ramp module with said inclined surfaces of said first and second inclined ramp modules being in line, said ramp system including first attachment means for connecting selected ones of said inclined ramp modules and said straight ramp modules for end-to-end alignment, connecting means for connecting said second inclined ramp module to said straight ramp module when in a stacked assembly, said inclined ramp modules having a generally resilient lip structure extending from the lower end of said inclined surfaces, said lip structure being of a preselected length to locate said lip structure of said second inclined ramp module proximate to the upper end of said inclined surface of said first inclined ramp module to provide a generally smooth transition between said inclined surfaces.

26. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be located adjacent to one of said end walls of said straight ramp module for end-to-end assembly, the longitudinal length of said triangularly shaped side walls of said inclined ramp module and the longitudinal length of said straight ramp module being substantially the same and the transverse width of said inclined ramp module and said straight ramp module being substantially the same to facilitate location of said bottom side of said inclined ramp module in a stacked aligned location upon said planar support surface of said straight ramp module, said end wall of said inclined ramp module being substantially of the same size as said end walls of said straight ramp module to facilitate end-to-end location and alignment, said ramp system formed in a stacked relationship with a first said inclined ramp module at the entrance at the ground surface connected end-to-end with one said straight ramp module at the ground surface, and including a second inclined ramp module supported on said planar support surface on said straight ramp module with said inclined surfaces of said first and second inclined ramp modules being in line, said ramp system including first attachment means for connecting selected ones of said inclined ramp modules and said straight ramp modules for end-to-end alignment, said first attachment means comprising at least one T-shaped protrusion and at least one T-shaped channel groove on said end wall of said inclined ramp module and on said one end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly matingly moved into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be in said small groove section at the lower end of said T-shaped channel groove with a relatively close tolerance fit and with a peripheral gap at the upper ends of said T-shaped protrusion and said T-shaped channel groove, said T-shaped protrusion being open at its lower end, connecting means for connecting said second inclined ramp module to said straight ramp module when in a stacked assembly, said connecting means including a connector having an opening at its lower end, said opening adapted to fit over the upper end of the T-shaped protrusion on said straight ramp module, the upper end of said connector adapted to fit within the opening at the lower end of said T-shaped protrusion whereby said second inclined ramp module and said straight ramp module will be secured together in the stacked condition.

27. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be located adjacent to one of said end walls of said straight ramp module for end-to-end assembly, the longitudinal length of said triangularly shaped side walls of said inclined ramp module and the longitudinal length of said straight ramp module being substantially the same and the transverse width of said inclined ramp module and said straight ramp module being substantially the same to facilitate location of said bottom side of said inclined ramp module in a stacked aligned location upon said planar support surface of said straight ramp module, said end wall of said inclined ramp module being substantially of the same size as said end walls of said straight ramp module to facilitate end-to-end location and alignment, said ramp system including a foot member which is a strip-like generally resilient structure adapted to be located on at least one of the edges including edges at said bottom side of said inclined ramp module and said bottom side of said straight module for contacting the ground surface to inhibit slippage, said edges including the edges of said lower extremities of said triangularly shaped side walls and the edges at said bottom portion of said some of said ribs of said inclined ramp module and the edges of said lower extremities of said rectangularly shaped side walls and the edges at said bottom portion of said some of said ribs of said straight ramp module, said foot member when applied to said at least one of the edges defining a channel portion when applied with side sections accepting said edges of varying thickness of said lower extremities of said triangularly shaped side walls of said inclined ramp module and said some of said ribs of said inclined ramp module and of said straight ramp module, said channel portion as applied having an opening at its upper end with said side sections being adapted to at least partially close said opening and adapted to be apart when said edges of said inclined ramp module and of said straight ramp module are moved into said channel portion and to close to grip said edges to retain said foot member to said at least one of said edges.

28. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface and alternatively adapted to be supported on said planar support surface of another of said straight ramp modules in a stacked relationship, said end wall of said inclined ramp module adapted to be secured to one of said end walls of said straight ramp module for end-to-end assembly, either one of said end walls at one end of said straight ramp module adapted to be secured to an end wall of another of said straight module for end-to-end assembly, first attachment means for connecting selected ones of said inclined ramp modules and said straight ramp modules for end-to-end alignment, said first attachment means comprising at least one T-shaped protrusion and at least one T-shaped channel groove on said end wall of said inclined ramp module and on said end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly matingly moved into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be located in said small groove section at the lower end of said T-shaped channel groove with a relatively close tolerance fit.

29. A ramp system for forming ramp assemblies of selectively variable configurations for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface and alternatively adapted to be supported on said planar support surface of another of said straight ramp modules in a stacked relationship, said end wall of said inclined ramp module adapted to be secured to one of said end walls of said straight ramp module for end-to-end assembly, either one of said end walls at one end of said straight ramp module adapted to be secured to the opposite end wall of another of said straight module for end-to-end assembly, said ramp being formable in a stacked relationship with a first said inclined ramp module at the entrance at the ground surface connected end-to-end with one said straight ramp module at the ground surface, and including a second inclined ramp module supported on said planar support surface on said straight ramp module with said inclined surfaces of said first and second inclined ramp modules being in line, said ramp system including first attachment means for connecting selected ones of said inclined ramp modules and said straight ramp modules for end-to-end alignment, said first attachment means comprising at least one T-shaped protrusion and at least one T-shaped channel groove on said end wall of said inclined ramp module and on said one end wall of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly matingly moved into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be located in said small groove section at the lower end of said T-shaped channel groove with a relatively close tolerance fit and with a peripheral gap at the upper ends of said T-shaped protrusion and said T-shaped channel groove, said T-shaped protrusion being open at its lower end, connecting means for connecting said second inclined ramp module to said straight ramp module when in a stacked assembly, said connecting means including a generally T-shaped connector having a T-shaped opening at its lower end, said T-shaped opening adapted to fit over the upper end of the T-shaped protrusion on said straight ramp module, the upper end of said T-shaped connector adapted to fit within the opening at the lower end of said T-shaped protrusion whereby said second inclined ramp module and said straight ramp module will be secured together in the stacked condition.

30. A ramp system for forming ramp assemblies of selectively variable configurations for providing aerial lift to users of rideable wheeled recreational products including skates, skateboards and bicycles comprising at least one ramp module of a configuration being an inclined ramp module being of a hollow construction with an inclined upper support surface supported on generally triangularly shaped side walls substantially over its length, said inclined ramp module having an end wall at one end of said side walls and at the upper end of said inclined surface, said inclined ramp module having a bottom side engageable with a ground surface, said end wall of said inclined ramp module adapted to be secured to an end wall of another ramp module of a hollow construction for end-to-end assembly, attachment means for selectively connecting said inclined ramp module and said other ramp module for end-to-end alignment, said attachment means comprising at least one T-shaped protrusion integrally formed on said end wall of said inclined ramp module and an end wall of said other ramp module and at least one T-shaped channel groove integrally formed on said end wall of said inclined ramp module and the end wall of said other ramp module, said T-shaped protrusions adapted to be slidingly, matingly moved into said T-shaped channel grooves, said T-shaped protrusions having a generally hollow construction opening to the inside of said modules and being closed at the top.

31. A ramp system for forming ramp assemblies of selectively variable configurations for providing aerial lift to users of rideable wheeled recreational products including skates, skateboards and bicycles comprising at least one ramp module of a configuration being an inclined ramp module having an inclined upper support surface supported on generally triangularly shaped side walls substantially over its length, said inclined ramp module having an end wall at one end of said side walls and at the upper end of said inclined surface, said inclined ramp module having a bottom side engageable with a ground surface, said end wall of said inclined ramp module adapted to be secured to an end wall of another ramp module for end-to-end assembly, attachment means for selectively connecting said inclined ramp module and said other ramp module for end-to-end alignment, said attachment means comprising at least one T-shaped protrusion integrally formed on one of said end wall of said inclined ramp module and an end wall of said other ramp module and at least one T-shaped channel groove integrally formed on the other one of said end wall of said inclined ramp module and the end wall of said other ramp module, said T-shaped protrusion adapted to be slidingly, matingly moved into said T-shaped channel groove, said inclined ramp module being of a generally hollow structure with said triangularly shaped side walls and end wall being of a relatively thin wall thickness, the lower extremities of said triangularly shaped side walls and end wall defining the bottom side of said inclined ramp module, said upper support surface being substantially uniformly flat over its length, said inclined ramp module having a plurality of generally flat internal ribs extending longitudinally and transversely across the bottom of said flat upper support surface at spaced intervals with substantially no distortion of said flat upper support surface, at least some of said internal ribs having end sections with a bottom portion extending inwardly and downwardly to substantially the same location as the extremities of said triangularly shaped side walls and said end wall to provide further support for said flat upper surface and said walls and end wall of said inclined ramp module at said bottom side.

32. A ramp system for forming ramp assemblies of selectively variable configurations for providing aerial lift to users of rideable wheeled recreational products including skates, skateboards and bicycles comprising at least one ramp module of a configuration being an inclined ramp module having an inclined upper support surface supported on generally triangularly shaped side walls substantially over its length, said inclined ramp module having an end wall at one end of said side walls and at the upper end of said inclined surface, said inclined ramp module having a bottom side engageable with a ground surface, said end wall of said inclined ramp module adapted to be secured to an end wall of another ramp module for end-to-end assembly, attachment means for selectively connecting said inclined ramp module and said other ramp module for end-to-end alignment, said attachment means comprising at least one T-shaped protrusion integrally formed on one of said end wall of said inclined ramp module and an end wall of said other ramp module and at least one T-shaped channel groove integrally formed on the other one of said end wall of said inclined ramp module and the end wall of said other ramp module, said T-shaped protrusion adapted to be slidingly, matingly moved into said T-shaped channel groove, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be located in said small groove section at the lower end of said T-shaped channel groove with a relatively close tolerance fit.

33. A ramp system for forming ramp assemblies of selectively variable configurations for providing aerial lift to users of rideable wheeled recreational products including skates, skateboards and bicycles comprising a plurality of ramp modules including at least one ramp module of a configuration being an inclined ramp module having an inclined upper support surface supported on generally triangularly shaped side walls substantially over its length, said inclined ramp module having an end wall at one end of said side walls and at the upper end of said inclined surface, said inclined ramp module having a bottom side engageable with a ground surface, said end wall of said inclined ramp module adapted to be secured to an end wall of another ramp module for end-to-end assembly, attachment means for selectively connecting said inclined ramp module and said other ramp module for end-to-end alignment, said attachment means comprising at least one first attachment structure integrally formed on one of said end wall of said inclined ramp module and on an end wall of said other ramp module and at least one second attachment structure integrally formed on the other one of said end wall of said inclined ramp module and the end wall of said other ramp module, said first and second attachment structures being of different interfitting constructions with said first attachment structure adapted to be engaged with said second attachment structure to lockingly secure said ramp modules together with said inclined ramp module being of a generally hollow structure with said triangularly shaped side walls and end wall being of a relatively thin wall thickness, the lower extremities of said triangularly shaped side walls and end wall defining the bottom side of said inclined ramp module, said upper support surface being substantially uniformly flat over its length, said inclined ramp module having a plurality of generally flat internal ribs extending longitudinally and transversely across the bottom of said flat upper support surface at spaced intervals with substantially no distortion of said flat upper support surface, at least some of said internal ribs having end sections with a bottom portion extending inwardly and downwardly to substantially the same location as the extremities of said triangularly shaped side walls and said end wall to provide further support for said flat upper support surface and said side walls and end wall of said inclined ramp module at said bottom side.

34. A ramp system for forming ramp assemblies for providing aerial lift to users of rideable wheeled recreational products including skates, skateboards and bicycles comprising ramp modules of at least two different configurations, one of said at least two ramp module configurations being an inclined ramp module having an inclined upper support surface supported on generally triangularly shaped side walls substantially over its length, said inclined ramp module having an end wall at one end of said side walls and at the upper end of said inclined surface, another of said at least two module configurations being a straight ramp module having a generally horizontal, planar upper support surface supported on generally rectangularly shaped side walls substantially over its length, said straight ramp module having end walls at opposite ends of said side walls and said straight support surface, said inclined ramp module having a bottom side engageable with a ground surface and alternatively adapted to be supported upon said planar support surface of said straight ramp module in a stacked relationship, said straight ramp module having a bottom side engageable with a ground surface, said end wall of said inclined ramp module adapted to be secured to one of said end walls of said straight ramp module for end-to-end assembly, said ramp system being formable in a stacked relationship with a first said inclined ramp module at the entrance at the ground surface connected end-to-end with said straight ramp module at the ground surface, and including a second inclined ramp module supported on said planar support surface on said straight ramp module with said inclined surfaces of said first and second inclined ramp modules being in line, said ramp system including first attachment means for connecting selected ones of said inclined ramp modules and said straight ramp modules for end-to-end alignment, said ramp system including second attachment means for connecting said inclined ramp modules side-by-side and for connecting said straight ramp modules side-by-side, said second attachment means comprising at least one T-shaped protrusion and at least one T-shaped channel groove on said side wall of said inclined ramp module and on said side wall of said straight ramp module with the same spacing between each, said T-shaped protrusion on said second inclined ramp module adapted to be in line with said T-shaped protrusion on said straight ramp module when supported on said upper support surface of said straight ramp module, said T-shaped protrusion on said another of said ramp modules being slidingly matingly movable into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be located in said small groove section at the lower end of said T-shaped channel groove with a relatively close tolerance fit and with a peripheral gap at the upper ends of said T-shaped protrusion and said T-shaped channel groove, said T-shaped protrusion being open at its lower end, connecting means for connecting said second inclined ramp module to said straight ramp module when in a stacked assembly, said connecting means including a connector having an opening at its lower end, said opening adapted to fit over the upper end of the T-shaped protrusion on said straight ramp module, the upper end of said connector adapted to fit within the opening at the lower end of said T-shaped protrusion on said second inclined ramp module whereby said second inclined ramp module and said straight ramp module will be secured together in the stacked condition.

35. The ramp system of claim 34 with said first attachment means comprising at least one T-shaped protrusion and at least one T-shaped channel groove on said end wall of said inclined ramp module and on said end walls of said straight ramp module with the same spacing between each, said T-shaped protrusion on one of said ramp modules adapted to be slidingly, matingly moved into said T-shaped channel groove on another of said ramp modules with said T-shaped protrusion on said another of said ramp modules being slidingly matingly moved into said T-shaped channel groove on said one of said ramp modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be in said small groove section at the lower end of said T-shaped channel groove with a relatively close tolerance fit and with a peripheral gap at the upper ends of said T-shaped protrusion and said T-shaped channel groove, said T-shaped protrusion being open at its lower end, said T-shaped protrusion and said T-shaped channel groove on the end wall of said second inclined ramp being in line with said T-shaped protrusion and said T-shaped channel groove on the end wall of said straight ramp module when supported on said upper support surface, said opening of said connector adapted to fit over the upper end of said T-shaped protrusion on said end wall of said straight ramp module, the upper end of said connector adapted to fit within the opening at the lower end of said T-shaped protrusion on said end wall of said second inclined ramp whereby said second inclined ramp module and said straight ramp module will be secured together in the stacked condition.

36. The ramp system of claim 35 with said connectors of said connecting means being T-shaped with said opening at said lower end being T-shaped and adapted to fit over the upper end of the T-shaped protrusions on said inclined and straight ramp modules and with said upper ends of said T-shaped protrusions of said inclined and straight ramp modules adapted to fit within the opening at said lower ends of said T-shaped protrusions whereby said second inclined ramp module and said straight ramp module will be secured together in the stacked condition.

37. A modular system for forming modular assemblies of selectively variable configurations for providing support to users comprising a plurality of straight modules each having a generally horizontal, planar upper support surface supported on generally rectangularly shaped side walls substantially over its length, said straight modules having generally rectangularly shaped end walls at opposite ends of said side walls and said straight support surface, said straight modules each having a bottom side engageable with a ground surface, said end walls of said straight modules adapted to be secured to said end walls of another of said straight modules for end-to-end assembly, said side walls of said straight modules adapted to be secured to said side walls of another of said straight modules for side-by-side assembly, attachment means for selectively connecting said straight modules for end-to-end alignment and for side-by-side alignment, said attachment means comprising at least one T-shaped protrusion and at least one T-shaped channel groove both integrally formed on said end walls and said side walls of said straight modules with the same spacing between each, said T-shaped protrusions on one of said straight modules adapted to be slidingly, matingly moved into said T-shaped channel grooves on another of said straight modules with said T-shaped protrusion on said another of said straight modules being slidingly, matingly moved into said T-shaped channel groove on said one of said straight modules, said T-shaped protrusion and said T-shaped channel groove being of a reverse tapered construction with said T-shaped protrusion partially engaging said T-shaped channel groove with a preselected close fit at their bottom surfaces when assembled.

38. The modular system of claim 37 with said bottom side being alternatively adapted to be supported on said planar support surface of another of said straight modules in a stacked relationship, connecting means for connecting said straight modules together when in a stacked assembly, said connecting means operable with the T-shaped protrusions on said straight modules when stacked whereby said straight modules will be secured together in the stacked condition.

39. The modular system of claim 38, with said straight module being of a generally hollow structure with said generally rectangularly shaped side walls and said end walls at opposite ends being of a relatively thin wall thickness, the lower extremities of said generally rectangularly shaped side walls and said end walls defining the bottom side of said straight module, said straight module having a plurality of longitudinally and transversely extending generally flat internal ribs, at least some of said internal ribs having at least a bottom portion extending downwardly to substantially the same location as the extremities of said generally rectangularly shaped side walls and said end walls to provide further support for said straight module at said bottom side, at least some of said internal ribs extending generally inwardly from said planar upper support surface with substantially no distortion of said planar upper support surface.

40. The modular system of claim 37 being formed as a ramped system and including an inclined module having an inclined upper support surface supported on generally triangularly shaped side walls, said inclined module having an end wall at one end of said side walls and at the upper end of said inclined surface, said inclined module having a bottom side engageable with a ground surface, said end wall of said inclined module adapted to be connected to one of said walls of said straight module, said end wail of said inclined module and said walls of said straight module being of substantially the same vertical height, second attachment means for connecting said inclined module and said straight modules, said second attachment means comprising at least one T-shaped protrusion and at least one T-shaped channel groove both integrally formed on said end wall of said inclined module with the same spacing between each as said T-shaped protrusion and said T-shaped channel groove on said straight module, said T-shaped protrusion on said inclined module adapted to be slidingly, matingly moved into said T-shaped channel groove on said straight module with said T-shaped protrusion on said straight module being slidingly, matingly moved into said T-shaped channel groove on said inclined module.

41. The modular system of claim 37 with said walls of said straight module having a vertical height of no less than around 12 inches.

42. A modular system for forming modular assemblies of selectively variable configurations for providing support to users comprising a plurality of straight modules each having a generally horizontal, planar upper support surface supported on generally rectangularly shaped side walls substantially over its length, said straight modules having generally rectangularly shaped end walls at opposite ends of said side walls and said straight support surface, said straight modules each having a bottom side engageable with a ground surface, said end walls of said straight modules adapted to be secured to said end walls of another of said straight modules for end-to-end assembly, said side walls of said straight modules adapted to be secured to side walls of another of said straight modules for side-by-side assembly, attachment means for selectively connecting said straight modules for end-to-end alignment and for side-by-side alignment, said attachment means comprising at least one T-shaped protrusion and at least one T-shaped channel groove both integrally formed on said end walls and said side walls of said straight modules with the same spacing between each, said T-shaped protrusions on one of said straight modules adapted to be slidingly, matingly moved into said T-shaped channel grooves on another of said straight modules with said T-shaped protrusion on said another of said straight modules being slidingly matingly moved into said T-shaped channel groove on said one of said straight modules, said T-shaped protrusions having a configuration tapering from a large protrusion section on its lower end to a small protrusion section at its upper end, said T-shaped channel groove having a configuration tapering from a small groove section at its lower end to a large groove section at its upper end, said large protrusion section at the lower end of said T-shaped protrusion adapted to be located in said small groove section at the lower end of said T-shaped channel groove with a relatively close tolerance fit.

43. The modular system of claim 42 with said bottom side of said straight modules being alternatively adapted to be supported on said planar support surface of another of said straight modules in a stacked relationship, said large protrusion section at the lower end of said T-shaped protrusion when located in said small groove section at the lower end of said T-shaped channel groove with a relatively close tolerance fit having a peripheral gap at the upper ends of said T-shaped protrusion and said T-shaped channel groove, said T-shaped protrusion being open at its lower end, connecting means for connecting said straight modules when in a stacked assembly, said connecting means including a generally T-shaped connector having a T-shaped opening at its lower end, said T-shaped opening adapted to fit over the upper end of the T-shaped protrusion on said straight module, the upper end of said T-shaped connector adapted to fit within the opening at the lower end of said T-shaped protrusion whereby said straight modules will be secured together in the stacked condition.

44. The modular system of claim 43 with said straight module being of a generally hollow structure with said generally rectangularly shaped sidewalls and said end walls at opposite ends being of a relatively thin wall thickness, the lower extremities of said generally rectangularly shaped side walls and said end walls defining the bottom side of said straight module, said straight module having a plurality of longitudinally and transversely extending internal ribs, at least some of said internal ribs having at least a bottom portion extending downwardly to substantially the same location as the extremities of said generally rectangularly shaped side walls and said end walls to provide further support for said straight module at said bottom side, at least some of said internal ribs extending generally inwardly from said planar upper support surface.

45. The modular system of claim 42 being formed as a ramped system and including an inclined module having an inclined upper support surface supported on generally triangularly shaped side walls, said inclined module having an end wall at one end of said side walls and at the upper end of said inclined surface, said inclined module having a bottom side engageable with a ground surface, said end wall of said inclined module adapted to be connected to one of said walls of said straight module, said end wall of said inclined module and said walls of said straight module being of substantially the same vertical height, second attachment means for connecting said inclined module and said straight modules, said second attachment means comprising at least one T-shaped protrusion and at least one T-shaped channel groove both integrally formed on said end wall of said inclined module with the same spacing between each as said T-shaped protrusion and said T-shaped channel groove on said straight module, said T-shaped protrusion on said inclined module adapted to be slidingly, matingly moved into said T-shaped channel groove on said straight module with said T-shaped protrusion on said straight module being slidingly, matingly moved into said T-shaped channel groove on said inclined module.

46. The modular system of claim 42 being formed as a ramped system and including an inclined module having an inclined upper support surface supported on generally triangularly shaped side walls, said inclined module having a bottom side adapted to be supported upon said planar support surface of said straight module in a stacked relationship, the longitudinal length of said triangularly shaped side walls of said inclined module and the longitudinal length of said straight module being substantially the same to facilitate location of said bottom side of said inclined module in a stacked aligned location upon said planar support surface of said straight module, said end wall of said inclined module and said walls of said straight module being of substantially the same vertical height, second attachment means comprising at least one T-shaped protrusion and at least one T-shaped channel groove on said walls of said inclined module with the same spacing between each as said T-shaped protrusion and said T-shaped channel groove on said straight modules, said T-shaped protrusions having a configuration tapering from a large protrusion section on its lower end to a small protrusion section at its upper end, said T-shaped channel groove having a configuration tapering from a small groove section at its lower end to a large groove section as its upper end, said large protrusion section at the lower end of said T-shaped protrusion adapted to be in said small groove section at the lower end of said T-shaped channel groove with a relatively close tolerance fit and with a peripheral gap at the upper ends of said T-shaped protrusion and said T-shaped channel groove, said T-shaped protrusion being open at its lower end, connecting means for connecting said inclined module to said straight module when in a stacked assembly, said connecting means including a connector having an opening at its lower end, said opening adapted to fit over the upper end of the T-shaped protrusion on said straight module, the upper end of said connector adapted to fit within the opening at the lower end of said T-shaped protrusion whereby said inclined module and said straight module will be secured together in the stacked condition.

47. The modular system of claim 42 with said walls of said straight module having a vertical height of no less than around 12 inches.

* * * * *